US012648589B2

(12) United States Patent
Jordil et al.

(10) Patent No.: US 12,648,589 B2
(45) Date of Patent: Jun. 9, 2026

(54) AEROSOL-GENERATING ARTICLE WITH UPSTREAM SECTION, HOLLOW TUBULAR ELEMENT AND VENTILATION

(71) Applicant: Philip Morris Products S.A., Neuchatel (CH)

(72) Inventors: Yves Jordil, Neuchatel (CH); Jerome Uthurry, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 297 days.

(21) Appl. No.: 18/247,780

(22) PCT Filed: Aug. 26, 2021

(86) PCT No.: PCT/EP2021/073682
§ 371 (c)(1),
(2) Date: Apr. 4, 2023

(87) PCT Pub. No.: WO2022/073692
PCT Pub. Date: Apr. 14, 2022

(65) Prior Publication Data

US 2023/0371585 A1 Nov. 23, 2023

(30) Foreign Application Priority Data

Oct. 9, 2020 (EP) ..... 20201025
Oct. 9, 2020 (EP) ..... 20201041
(Continued)

(51) Int. Cl.
*A24D 1/20* (2020.01)
*A24B 15/12* (2006.01)
(Continued)

(52) U.S. Cl.
CPC ..... *A24D 1/20* (2020.01); *A24B 15/12* (2013.01); *A24D 1/027* (2013.01); *A24D 1/042* (2013.01);
(Continued)

(58) Field of Classification Search
CPC .. A24D 1/027; A24D 1/20; A24D 3/17; A24F 40/20
See application file for complete search history.

(56) References Cited

U.S. PATENT DOCUMENTS 5,499,636 A 3/1996 Baggett, Jr. et al.
5,692,525 A 12/1997 Counts et al.
(Continued)

FOREIGN PATENT DOCUMENTS

CA 3 116 279 A1 6/2020
CN 104203015 A 12/2014
(Continued)

OTHER PUBLICATIONS

International Search Report & Written Opinion issued Mar. 1, 2022 in PCT/EP2021/073682 filed on Aug. 26, 2021, 8 pages.
(Continued)

*Primary Examiner* — Eric Yaary
(74) *Attorney, Agent, or Firm* — Oblon, McClelland, Maier & Neustadt, L.L.P.

(57) ABSTRACT

An aerosol-generating article is provided, including: a rod of aerosol-generating substrate having a length of between 8 mm and 16 mm; an upstream element provided upstream of the rod of aerosol-generating substrate, the upstream element having an external diameter of between 6 mm and 8 mm; a hollow tubular element provided downstream of the rod of aerosol-generating substrate, an internal volume defined by the hollow tubular element being at least 300 cubic millimetres; and a ventilation zone configured to
(Continued)

provide ventilation into the aerosol-generating article, the ventilation zone being located between 12 mm and 20 mm upstream from a downstream end of the aerosol-generating article. An aerosol-generating system including an aerosol-generating article and an aerosol-generating device is also provided.

15 Claims, 2 Drawing Sheets

(30) Foreign Application Priority Data

Oct. 9, 2020 (EP) ..... 20201046
Oct. 9, 2020 (EP) ..... 20201052
Oct. 9, 2020 (EP) ..... 20201125
Oct. 9, 2020 (EP) ..... 20201137

(51) Int. Cl.
*A24D 1/02* (2006.01)
*A24D 1/04* (2006.01)
*A24D 3/02* (2006.01)
*A24D 3/10* (2006.01)
*A24D 3/17* (2020.01)
*A24F 40/20* (2020.01)

(52) U.S. Cl.
CPC ..... *A24D 1/045* (2013.01); *A24D 3/0279* (2013.01); *A24D 3/10* (2013.01); *A24D 3/17* (2020.01); *A24F 40/20* (2020.01)

(56) References Cited

U.S. PATENT DOCUMENTS

| | | | | |
|---|---|---|---|---|
| 8,353,302 | B2 | 1/2013 | Olegario et al. | |
| 10,617,149 | B2 | 4/2020 | Malgat et al. | |
| 10,660,364 | B2 | 5/2020 | Ajithkumar et al. | |
| 2008/0092912 | A1* | 4/2008 | Robinson | H05B 3/42 131/200 |
| 2012/0006343 | A1* | 1/2012 | Renaud | A24D 1/22 131/194 |
| 2012/0048286 | A1 | 3/2012 | Luan et al. | |
| 2014/0345634 | A1 | 11/2014 | Zuber et al. | |
| 2015/0313281 | A1 | 11/2015 | Bonici et al. | |
| 2016/0309782 | A1 | 10/2016 | Malgat et al. | |
| 2016/0331032 | A1 | 11/2016 | Malgat et al. | |
| 2018/0116277 | A1 | 5/2018 | Besso | |
| 2020/0008462 | A1 | 1/2020 | Thorens | |
| 2020/0113227 | A1 | 4/2020 | Mclaughlin et al. | |
| 2020/0205468 | A1 | 7/2020 | Nappi et al. | |
| 2020/0384221 | A1 | 12/2020 | Lang | |
| 2021/0100283 | A1* | 4/2021 | Ballesteros Gomez | A24F 40/46 |
| 2022/0030935 | A1 | 2/2022 | Uthurry | |

FOREIGN PATENT DOCUMENTS

| | | | |
|---|---|---|---|
| CN | 105231 486 | A | 1/2016 |
| CN | 108601407 | A | 9/2018 |
| EA | 2 921 065 | A1 | 9/2015 |
| EP | 0 822 760 | A2 | 2/1998 |
| EP | 0 836 390 | B1 | 4/1998 |
| EP | 2 173 204 | B1 | 4/2010 |
| EP | 2 797 450 | B1 | 11/2014 |
| EP | 2 760 303 | B1 | 5/2015 |
| EP | 2 967 137 | B1 | 1/2016 |
| EP | 3 566 590 | A1 | 11/2019 |
| EP | 3 426 071 | B1 | 2/2020 |
| EP | 3 616 537 | A1 | 3/2020 |
| GB | 2 126 073 | A | 3/1984 |
| JP | 11 503912 | A | 4/1999 |
| JP | 2019-512235 | A | 5/2018 |
| JP | 2020-513738 | A | 5/2020 |
| JP | 2020-114206 | A | 7/2020 |
| KR | 10-2020-0051130 | A | 6/2020 |
| KR | 10-2020-0061072 | A | 6/2020 |
| KR | 10-2020-0061290 | A | 6/2020 |
| RU | 2 116 040 | C1 | 7/1998 |
| RU | 2 620 491 | C2 | 5/2017 |
| RU | 2 672 657 | C2 | 11/2018 |
| WO | WO 99/00027 | A1 | 1/1999 |
| WO | WO 2010/133334 | A1 | 11/2010 |
| WO | WO 2013/098410 | A2 | 7/2013 |
| WO | WO 2015/176898 | A1 | 11/2015 |
| WO | WO 2016/146781 | A1 | 9/2016 |
| WO | WO 2019/063737 | A1 | 4/2019 |
| WO | WO 2019/096983 | A1 | 5/2019 |
| WO | WO 2019/123048 | A1 | 6/2019 |
| WO | WO 2019/186337 | A1 | 10/2019 |
| WO | WO 2020/089091 | A1 | 5/2020 |
| WO | WO 2020/091394 | A1 | 5/2020 |
| WO | WO 2020/100872 41 | | 5/2020 |
| WO | WO 2020/115151 | A1 | 6/2020 |
| WO | WO 2020/128043 | A1 | 6/2020 |
| WO | WO 2020/128045 | A1 | 6/2020 |
| WO | WO 2020/128048 | A1 | 6/2020 |
| WO | WO 2020/183161 | A1 | 9/2020 |
| WO | WO 2020/183175 | A1 | 9/2020 |
| WO | WO 2020/250108 | A1 | 12/2020 |
| WO | WO 2020/250109 | A1 | 12/2020 |
| WO | WO 2020/250111 | A1 | 12/2020 |
| WO | WO 2020/250112 | A1 | 12/2020 |
| WO | WO 2020/250114 | A1 | 12/2020 |
| WO | WO 2021/110596 | A1 | 6/2021 |
| WO | WO 2021/170638 | A1 | 9/2021 |
| WO | WO 2021/170649 | A1 | 9/2021 |
| WO | WO 2021/197810 | A1 | 10/2021 |
| WO | WO 2021/233914 | A1 | 11/2021 |
| WO | WO 2021/233916 | A1 | 11/2021 |
| WO | WO 2021/233918 | A1 | 11/2021 |
| WO | WO 2022/018301 | A1 | 1/2022 |

OTHER PUBLICATIONS

Combined Russian Office Action and Search Report issued Dec. 24, 2024 in Russian Patent Application No. 2023110554/03, 7 pages.
Extended European Search Report issued Mar. 16, 2021 in European Patent Application No. 20201046.8, 9 pages.
Extended European Search Report issued Mar. 18, 2021 in European Patent Application No. 20201137.5, 10 pages.
Extended European Search Report issued Mar. 22, 2021 in European Patent Application No. 20201052.6, 8 pages.
Extended European Search Report issued Apr. 15, 2021 in European Patent Application No. 20201041.9, 7 pages.
Extended European Search Report issued Apr. 15, 2021 in European Patent Application No. 20201025.2, 8 pages.
Extended European Search Report issued Apr. 16, 2021 in European Patent Application No. 20201125.0, 7 pages.
Combined Chinese Office Action issued Jul. 2, 2025 in Chinese Patent Application No. 202180067492.4 (with English Translation), 4 pages.
Brazilian Office Action issued Jun. 17, 2025, in Brazilian Patent Application No. 1120230065089 (with English translation), 5 pages.
Japanese Office Action issued Sep. 8, 2025 in corresponding Japanese Patent Application No. 2023-520194, with English Translation, 8 pages.

* cited by examiner

AEROSOL-GENERATING ARTICLE WITH UPSTREAM SECTION, HOLLOW TUBULAR ELEMENT AND VENTILATION

The present invention relates to an aerosol-generating article comprising an aerosol-generating substrate and being adapted to produce an inhalable aerosol upon heating. The present disclosure also relates to an aerosol-generating system comprising an aerosol-generating device and such an aerosol-generating article.

Aerosol-generating articles in which an aerosol-generating substrate, such as a tobacco-containing substrate, is heated rather than combusted, are known in the art. Typically, in such heated smoking articles an aerosol is generated by the transfer of heat from a heat source to a physically separate aerosol-generating substrate or material, which may be located in contact with, within, around, or downstream of the heat source. During use of the aerosol-generating article, volatile compounds are released from the aerosol-generating substrate by heat transfer from the heat source and are entrained in air drawn through the aerosol-generating article. As the released compounds cool, they condense to form an aerosol.

A number of prior art documents disclose aerosol-generating devices for consuming aerosol-generating articles. Such devices include, for example, electrically heated aerosol-generating devices in which an aerosol is generated by the transfer of heat from one or more electrical heater elements of the aerosol-generating device to the aerosol-generating substrate of a heated aerosol-generating article. For example, electrically heated aerosol-generating devices have been proposed that comprise an internal heater blade which is adapted to be inserted into the aerosol-generating substrate. Use of an aerosol-generating article in combination with an external heating system is also known. For example, WO 2020/115151 describes the provision of one or more heating elements arranged around the periphery of the aerosol-generating article when the aerosol-generating article is received in a cavity of the aerosol-generating device. As an alternative, inductively heatable aerosol-generating articles comprising an aerosol-generating substrate and a susceptor arranged within the aerosol-generating substrate have been proposed by WO 2015/176898.

Aerosol-generating articles in which a tobacco-containing substrate is heated rather than combusted present a number of challenges that were not encountered with conventional smoking articles. First of all, tobacco-containing substrates are typically heated to significantly lower temperatures compared with the temperatures reached by the combustion front in a conventional cigarette. This may have an impact on nicotine release from the tobacco-containing substrate and nicotine delivery to the consumer. At the same time, if the heating temperature is increased in an attempt to boost nicotine delivery, then the aerosol generated typically needs to be cooled to a greater extent and more rapidly before it reaches the consumer. However, technical solutions that were commonly used for cooling the mainstream smoke in conventional smoking articles, such as the provision of a high filtration efficiency segment at the mouth end of a cigarette, may have undesirable effects in an aerosol-generating article wherein a tobacco-containing substrate is heated rather than combusted, as they may reduce nicotine delivery. Accordingly, it would be desirable to provide novel aerosol-generating articles that can consistently ensure a satisfactory aerosol delivery to the consumer.

Secondly, a need is generally felt for aerosol-generating articles that are easy to use and have improved practicality.

For example, it would be desirable to provide an aerosol-generating article that can be easily inserted into a heating cavity of the aerosol-generating device, and that at the same time can be held securely within the heating cavity such that it does not slip out during use.

Therefore, it would be desirable to provide a new and improved aerosol-generating article adapted to achieve at least one of the desirable results described above. Further, it would be desirable to provide one such aerosol-generating article that can be manufactured efficiently and at high speed, preferably with a satisfactory RTD and low RTD variability from one article to another.

The present disclosure relates to an aerosol-generating article. The aerosol-generating article may comprise a rod of aerosol-generating substrate having a length of between about 8 mm and about 16 mm. The aerosol-generating article may comprise an upstream section. The upstream section may comprise an upstream element. The upstream element may be provided upstream of the rod of aerosol-generating substrate. The upstream element may have an external diameter of between about 6 mm and about 8 mm. The aerosol-generating article may comprise a hollow tubular element. The hollow tubular element may be provided downstream of the rod of aerosol-generating substrate. An internal volume defined by the hollow tubular element may be at least about 300 cubic millimetres. The aerosol-generating article may comprise a ventilation zone for providing ventilation into the aerosol-generating article. The ventilation zone may be located between 12 mm and 20 mm upstream from the downstream end of the aerosol-generating article.

According to the present invention, there is provided an aerosol-generating article comprising a rod of aerosol-generating substrate having a length of between about 8 mm and about 16 mm. The aerosol-generating article comprises an upstream element. The upstream element is provided upstream of the rod of aerosol-generating substrate. The upstream element has an external diameter of between about 6 mm and about 8 mm. The aerosol-generating article comprises a hollow tubular element. The hollow tubular element is provided downstream of the rod of aerosol-generating substrate. An internal volume defined by the hollow tubular element is at least about 300 cubic millimetres. The aerosol-generating article comprises a ventilation zone for providing ventilation into the aerosol-generating article. The ventilation zone is located between 12 mm and 20 mm upstream from the downstream end of the aerosol-generating article.

Further, according to the present disclosure, there is provided an aerosol-generating system comprising an aerosol-generating article as set out above and an aerosol-generating device, wherein the aerosol-generating device comprises a heating chamber for receiving the aerosol-generating article and a heating member arranged at or about a periphery of the heating chamber.

The aerosol-generating article according to the present invention provides an improved configuration of that reduces the potential risk of accidental misalignment or exit of an aerosol-generating article during use in an aerosol-generating device, which could be detrimental to articles having a ventilation zone. Providing a ventilation zone within a defined range of relatively long distances away from the downstream end consistently minimises the risk of a user inadvertently obstructing the ventilation zone during use. However, effective placement and engagement of the article within the device is necessary to ensure the article does not fall or slide out from the device cavity throughout use, thereby potentially countering the benefits of said defined location of the ventilation zone.

The inadvertent sliding out or exit of an article from a device could expose the ventilation zone further than intended. This could increase both the risk of obstruction of the ventilation zone even more than when the article was suitably received within the device and the risk of misalignment of a predefined substrate length with a heating element of the device. Therefore, the provision of a predefined, relatively wide upstream element and a predefined, relatively long rod of aerosol-generating substrate contributes towards providing a consistent anchoring of the article within a device, thereby minimising such a risk of accidental exit or misalignment.

Throughout heating of the rod of aerosol-generating substrate, the substrate may gradually shrink, which can be detrimental to the fit of the article within the device. Providing a non-substrate component upstream of the substrate improves the engagement or anchoring of the article within the device because the upstream element will be able to engage with the device cavity, while the aerosol-generating substrate portion may partially and progressively lose engagement during use as it shrinks. In the event of any partial sliding or exit of the aerosol-generating article from device cavity, a defined length of the rod of aerosol-generating element may guarantee consistent alignment of the heater with at least part of the aerosol-generating element.

Additionally, in an aerosol-generating article in accordance with the present invention, the length of the rod of aerosol-generating substrate, the internal cavity volume of the hollow tubular element and the placement of the ventilation zone relative to the downstream end of the article have been selected in order to provide for a rapid cooling of the species flowing along the cavity defined internally by the hollow tubular element. The intense cooling caused by the ingress of ambient air drawn into the cavity internally defined by the hollow tubular element through the ventilation zone is understood to accelerate the condensation of aerosol former (e.g. glycerin) droplets, onto which the volatilised nicotine and organic acids released upon heating the tobacco substrate accumulate and combine into nicotine salts. With this in mind, the placement of the ventilation zone relative to the downstream end of the article has been selected with a view to reducing the fly time of the volatilised nicotine before the volatilised nicotine reaches the aerosol former droplets and minimise the risk of occlusion of the ventilation zone by a user's lips, as well as to make time and room for the accumulation of nicotine and formation of nicotine salts within the aerosol former droplets to occur before the aerosol stream reaches the consumer's mouth.

Thus, the selected diameter of the upstream element, internal volume defined by the hollow tubular element and distance between the ventilation zone and downstream end of the article in articles in accordance with the present invention provide a combination that optimises placement of the substrate within the aerosol-generating device and placement of the ventilation zone to enhance aerosol generation and delivery to the consumer.

As mentioned above, an aerosol-generating article in accordance with the present invention comprises a rod of aerosol-generating substrate. Further, an aerosol-generating article in accordance with the present invention comprises one or more elements provided downstream of the aerosol-generating substrate. The one or more elements downstream of the rod of aerosol-generating substrate form a downstream section of the aerosol-generating article. Additionally, an aerosol-generating article in accordance with the present invention may comprise an element provided upstream of the aerosol-generating substrate. The element upstream of the rod of aerosol-generating substrate defines an upstream section of the aerosol-generating article.

As set out above, the aerosol-generating article according to the present invention comprises a rod of aerosol-generating substrate. The rod of aerosol-generating substrate is preferably circumscribed by a wrapper, such as a plug wrap.

The rod of aerosol-generating substrate preferably has a length of at least about 8 millimetres. Preferably, the rod of aerosol-generating substrate has a length of at least about 9 millimetres. More preferably, the rod of aerosol-generating substrate has a length of at least about 10 millimetres.

For example, the rod of aerosol-generating substrate preferably has a length of between about 8 millimetres and about 16 millimetres, or between about 9 millimetres and about 15 millimetres, or between about 10 millimetres and about 14 millimetres. In a particularly preferred embodiment, the rod of aerosol-generating substrate has a length of about 12 millimetres.

Preferably the ratio of the length of the rod of aerosol-generating substrate to the total length of the aerosol-generating article is at least about 0.15, more preferably at least about 0.2, most preferably at least about 0.22.

Preferably, the ratio of the length of the rod of aerosol-generating substrate to the total length of the aerosol-generating article is less than or equal to 0.35, more preferably less than or equal to about 0.33, more preferably less than or equal to about 0.3.

In particularly preferred embodiments of the present invention, the ratio of the length of the rod of aerosol-generating substrate to the total length of the aerosol-generating article is approximately 0.25.

By adjusting the length of the rod of aerosol-generating substrate within any of the ranges described above, and by controlling the density of the aerosol-generating substrate itself, the inventors have found that it is easier to better and more consistently control the overall RTD of the aerosol-generating article. Further, as the length of the rod is also predefined, it is easier to ensure a desirable placement of a ventilation zone relative to the substrate and to the heating device, during use.

The rod of aerosol-generating substrate preferably has an external diameter that is approximately equal to the external diameter of the aerosol-generating article.

The "external diameter of the rod of aerosol-generating substrate" may be calculated as the average of a plurality of measurements of the diameter of the rod of aerosol-generating substrate taken at different locations along the length of the rod of aerosol-generating substrate.

Preferably, the rod of aerosol-generating substrate has an external diameter of at least about 5 millimetres. More preferably, the rod of aerosol-generating substrate has an external diameter of at least about 6 millimetres. Even more preferably, the rod of aerosol-generating substrate has an external diameter of at least about 7 millimetres.

The rod of aerosol-generating substrate preferably has an external diameter of less than or equal to about 12 millimetres. More preferably, the rod of aerosol-generating substrate has an external diameter of less than or equal to about 10 millimetres. Even more preferably, the rod of aerosol-generating substrate has an external diameter of less than or equal to about 8 millimetres.

In general, it has been observed that the smaller the diameter of the rod of aerosol-generating substrate, the lower the temperature that is required to raise a core temperature of the rod of aerosol-generating substrate such that sufficient amounts of vaporizable species are released from the aerosol-generating substrate to form a desired amount of aerosol. At the same time, without wishing to be bound by theory, it is understood that a smaller diameter of the rod of aerosol-generating substrate allows for a faster penetration of heat supplied to the aerosol-generating article into the entire volume of aerosol-forming substrate. Nevertheless, where the diameter of the rod of aerosol-generating substrate is too small, a volume-to-surface ratio of the aerosol-generating substrate becomes less favourable, as the amount of available aerosol-forming substrate diminishes.

A diameter of the rod of aerosol-generating substrate falling within the ranges described herein is particularly advantageous in terms of a balance between energy consumption and aerosol delivery. This advantage is felt in particular when an aerosol-generating article comprising a rod of aerosol-generating substrate having a diameter as described herein is used in combination with an external heater arranged around the periphery of the aerosol-generating article. Under such operating conditions, it has been observed that less thermal energy is required to achieve a sufficiently high temperature at the core of the rod of aerosol-generating substrate and, in general, at the core of the article. Thus, when operating at lower temperatures, a desired target temperature at the core of the aerosol-generating substrate may be achieved within a desirably reduced time frame and by a lower energy consumption.

In some embodiments, the rod of aerosol-generating substrate has an external diameter from about 5 millimetres to about 12 millimetres, preferably from about 6 millimetres to about 12 millimetres, more preferably from about 7 millimetres to about 12 millimetres. In other embodiments, the rod of aerosol-generating substrate has an external diameter from about 5 millimetres to about 12 millimetres, preferably from about 6 millimetres to about 10 millimetres, more preferably from about 7 millimetres to about 10 millimetres. In further embodiments, the rod of aerosol-generating substrate has an external diameter from about 5 millimetres to about 8 millimetres, preferably from about 6 millimetres to about 8 millimetres, more preferably from about 7 millimetres to about 8 millimetres.

In particularly preferred embodiments, the rod of aerosol-generating substrate has an external diameter of less than about 7.5 millimetres. By way of example, the rod of aerosol-generating substrate may an external diameter of about 7.2 millimetres.

A ratio between the length of the rod of aerosol-generating substrate and an overall length of the aerosol-generating article may be at least about 0.10. Preferably, a ratio between the length of the rod of aerosol-generating substrate and an overall length of the aerosol-generating article is at least about 0.15. More preferably, a ratio between the length of the rod of aerosol-generating substrate and an overall length of the aerosol-generating article is at least about 0.20. Even more preferably, a ratio between the length of the rod of aerosol-generating substrate and an overall length of the aerosol-generating article is at least about 0.25.

In general, a ratio between the length of the rod of aerosol-generating substrate and an overall length of the aerosol-generating article may be less than or equal to about 0.60. Preferably, a ratio between the length of the rod of aerosol-generating substrate and an overall length of the aerosol-generating article is less than or equal to about 0.50. More preferably, a ratio between the length of the rod of aerosol-generating substrate and an overall length of the aerosol-generating article is less than or equal to about 0.45. Even more preferably, a ratio between the length of the rod of aerosol-generating substrate and an overall length of the aerosol-generating article is less than or equal to about 0.40. In particularly preferred embodiments, a ratio between the length of the rod of aerosol-generating substrate and an overall length of the aerosol-generating article is less than or equal to about 0.35, and most preferably less than or equal to about 0.30.

In some embodiments, a ratio between the length of the rod of aerosol-generating substrate and an overall length of the aerosol-generating article is from about 0.10 to about 0.45, preferably from about 0.15 to about 0.45, more preferably from about 0.20 to about 0.45, even more preferably from about 0.25 to about 0.45. In other embodiments, a ratio between the length of the rod of aerosol-generating substrate and an overall length of the aerosol-generating article is from about 0.10 to about 0.40, preferably from about 0.15 to about 0.40, more preferably from about 0.20 to about 0.40, even more preferably from about 0.25 to about 0.40. In further embodiments, a ratio between the length of the rod of aerosol-generating substrate and an overall length of the aerosol-generating article is from about 0.10 to about 0.35, preferably from about 0.15 to about 0.35, more preferably from about 0.20 to about 0.35, even more preferably from about 0.25 to about 0.35. In yet further embodiments, a ratio between the length of the rod of aerosol-generating substrate and an overall length of the aerosol-generating article is from about 0.10 to about 0.30, preferably from about 0.15 to about 0.30, more preferably from about 0.20 to about 0.30, even more preferably from about 0.25 to about 0.30.

Preferably, the rod of aerosol-generating substrate has a substantially uniform cross-section along the length of the rod. Particularly preferably, the rod of aerosol-generating substrate has a substantially circular cross-section.

In an aerosol-generating article in accordance with the present invention, a ratio between the length of the rod of aerosol-generating substrate and an overall length of the aerosol-generating article may be less than or equal to about 0.60. Preferably, a ratio between the length of the rod of aerosol-generating substrate and an overall length of the aerosol-generating article may be less than or equal to about 0.50. More preferably, a ratio between the length of the rod of aerosol-generating substrate and an overall length of the aerosol-generating article may be less than or equal to about 0.40. Even more preferably, a ratio between the length of the rod of aerosol-generating substrate and an overall length of the aerosol-generating article may be less than or equal to about 0.30.

In an aerosol-generating article in accordance with the present invention a ratio between the length of the rod of aerosol-generating substrate and an overall length of the aerosol-generating article may be at least about 0.10. Preferably, a ratio between the length of the rod of aerosol-generating substrate and an overall length of the aerosol-generating article may be at least about 0.15. More preferably, a ratio between the length of the rod of aerosol-generating substrate and an overall length of the aerosol-generating article may be at least about 0.20. In particularly preferred embodiments, a ratio between the length of the rod of aerosol-generating substrate and an overall length of the aerosol-generating article may be at least about 0.25.

In some embodiments, a ratio between the length of the rod of aerosol-generating substrate and an overall length of the aerosol-generating article is from about 0.10 to about 0.60, preferably from about 0.15 to about 0.60, more preferably from about 0.20 to about 0.60, even more preferably from about 0.25 to about 0.60. In other embodiments, a ratio between the length of the rod of aerosol-generating substrate and an overall length of the aerosol-generating article is from about 0.10 to about 0.50, preferably from about 0.15 to about 0.50, more preferably from about 0.20 to about 0.50, even more preferably from about 0.25 to about 0.50. In further embodiments, a ratio between the length of the rod of aerosol-generating substrate and an overall length of the aerosol-generating article is from about 0.10 to about 0.40, preferably from about 0.15 to about 0.40, more preferably from about 0.20 to about 0.40, even more preferably from about 0.25 to about 0.40. By way of example, a ratio between the length of the rod of aerosol-generating substrate and an overall length of the aerosol-generating article may be from about 0.25 to about 0.30, preferably about 0.27.

Preferably, the density of the aerosol-generating substrate is at least about 150 mg per cubic centimetre. More preferably, the density of the aerosol-generating substrate is at least about 175 mg per cubic centimetre. More preferably, the density of the aerosol-generating substrate is at least about 200 mg per cubic centimetre. Even more preferably, the density of the aerosol-generating substrate is at least about 250 mg per cubic centimetre.

Preferably, the density of the aerosol-generating substrate is less than or equal to about 500 mg per cubic centimetre. More preferably, the density of the aerosol-generating substrate is less than or equal to about 450 mg per cubic centimetre. More preferably, the density of the aerosol-generating substrate is less than or equal to about 400 mg per cubic centimetre. Even more preferably, the density of the aerosol-generating substrate is less than or equal to about 350 mg per cubic centimetre.

For example, the density of the aerosol-generating substrate is preferably from about 150 mg per cubic centimetre to about 500 mg per cubic centimetre, preferably from about 175 mg per cubic centimetre to about 450 mg per cubic centimetre, more preferably from about 200 mg per cubic centimetre to about 400 mg per cubic centimetre, even more preferably from 250 mg per cubic centimetre to 350 mg per cubic centimetre. In a particularly preferred embodiment of the invention, the density of the aerosol-generating substrate is about 300 mg per cubic centimetre.

In certain preferred embodiments, the rod of aerosol-generating substrate comprises shredded tobacco material, for example tobacco cut filler, having a density of between about 150 mg per cubic centimetre and about 500 mg per cubic centimetre, preferably between about 175 mg per cubic centimetre and about 450 mg per cubic centimetre, more preferably between about 200 mg per cubic centimetre and about 400 mg per cubic centimetre, more preferably between about 250 mg per cubic centimetre and about 350 mg per cubic centimetre, most preferably about 300 mg per cubic centimetre.

The RTD of the rod of aerosol-generating substrate is preferably less than or equal to about 10 millimetres $H_2O$. More preferably, the RTD of the rod of aerosol-generating substrate is less than or equal to about 9 millimetres $H_2O$. Even more preferably, the RTD of the rod of aerosol-generating substrate is less than or equal to about 8 millimetres $H_2O$.

The RTD of the rod of aerosol-generating substrate is preferably at least about 4 millimetres $H_2O$. More preferably, the RTD of the rod of aerosol-generating substrate is at least about 5 millimetres $H_2O$. Even more preferably, the RTD of the rod of aerosol-generating substrate is at least about 6 millimetres $H_2O$.

In some embodiments, the RTD of the rod of aerosol-generating substrate is from about 4 millimetres $H_2O$ to about 10 millimetres $H_2O$, preferably from about 5 millimetres $H_2O$ to about 10 millimetres $H_2O$, preferably from about 6 millimetres $H_2O$ to about 25 millimetres $H_2O$. In other embodiments, the RTD of the rod of aerosol-generating substrate is from about 4 millimetres $H_2O$ to about 20 millimetres $H_2O$, preferably from about 5 millimetres $H_2O$ to about 18 millimetres $H_2O$ preferably from about 6 millimetres $H_2O$ to about 16 millimetres $H_2O$. In further embodiments, the RTD of the rod of aerosol-generating substrate is from about 4 millimetres $H_2O$ to about 15 millimetres $H_2O$, preferably from about 5 millimetres $H_2O$ to about 14 millimetres $H_2O$, more preferably from about 6 millimetres $H_2O$ to about 12 millimetres $H_2O$.

The aerosol-generating substrate may be a solid aerosol-generating substrate. The aerosol-generating substrate preferably comprises an aerosol former. The aerosol former may be any suitable known compound or mixture of compounds that, in use, facilitates formation of a dense and stable aerosol. The aerosol former may be facilitating that the aerosol is substantially resistant to thermal degradation at temperatures typically applied during use of the aerosol-generating article. Suitable aerosol formers are for example: polyhydric alcohols such as, for example, triethylene glycol, 1,3-butanediol, propylene glycol and glycerine; esters of polyhydric alcohols such as, for example, glycerol mono-, di- or triacetate; aliphatic esters of mono-, di- or polycarboxylic acids such as, for example, dimethyl dodecanedioate and dimethyl tetradecanedioate; and combinations thereof.

Preferably, the aerosol former comprises one or more of glycerine and propylene glycol. The aerosol former may consist of glycerine or propylene glycol or of a combination of glycerine and propylene glycol.

Preferably, the aerosol-generating substrate comprises at least 5 percent by weight of aerosol former on a dry weight basis of the aerosol-generating substrate, more preferably between 10 percent and 22 percent by weight on a dry weight basis of the cut aerosol-generating substrate, more preferably, the amount of aerosol former is between 12 percent and 19 percent by weight on a dry weight basis of the aerosol-generating substrate, most for example the amount of aerosol former is between 13 percent and 16 percent by weight on a dry weight basis of the aerosol-generating substrate.

In certain preferred embodiments of the invention, the aerosol-generating substrate comprises shredded tobacco material. For example, the shredded tobacco material may be in the form of cut filler, as described in more detail below. Alternatively, the shredded tobacco material may be in the form of a shredded sheet of homogenised tobacco material. Suitable homogenised tobacco materials for use in the present invention are described below.

Within the context of the present specification, the term "cut filler" is used to describe to a blend of shredded plant material, such as tobacco plant material, including, in particular, one or more of leaf lamina, processed stems and ribs, homogenised plant material.

The cut filler may also comprise other after-cut, filler tobacco or casing.

Preferably, the cut filler comprises at least 25 percent of plant leaf lamina, more preferably, at least 50 percent of plant leaf lamina, still more preferably at least 75 percent of plant leaf lamina and most preferably at least 90 percent of plant leaf lamina. Preferably, the plant material is one of tobacco, mint, tea and cloves. Most preferably, the plant material is tobacco. However, as will be discussed below in greater detail, the invention is equally applicable to other plant material that has the ability to release substances upon the application of heat that can subsequently form an aerosol.

Preferably, the cut filler comprises tobacco plant material comprising lamina of one or more of bright tobacco, dark tobacco, aromatic tobacco and filler tobacco. With reference to the present invention, the term "tobacco" describes any plant member of the genus *Nicotiana*.

Bright tobaccos are tobaccos with a generally large, light coloured leaves. Throughout the specification, the term "bright tobacco" is used for tobaccos that have been flue cured. Examples for bright tobaccos are Chinese Flue-Cured, Flue-Cured Brazil, US Flue-Cured such as Virginia tobacco, Indian Flue-Cured, Flue-Cured from Tanzania or other African Flue Cured. Bright tobacco is characterized by a high sugar to nitrogen ratio. From a sensorial perspective, bright tobacco is a tobacco type which, after curing, is associated with a spicy and lively sensation. Within the context of the present invention, bright tobaccos are tobaccos with a content of reducing sugars of between about 2.5 percent and about 20 percent of dry weight base of the leaf and a total ammonia content of less than about 0.12 percent of dry weight base of the leaf. Reducing sugars comprise for example glucose or fructose. Total ammonia comprises for example ammonia and ammonia salts.

Dark tobaccos are tobaccos with a generally large, dark coloured leaves. Throughout the specification, the term "dark tobacco" is used for tobaccos that have been air cured. Additionally, dark tobaccos may be fermented. Tobaccos that are used mainly for chewing, snuff, cigar, and pipe blends are also included in this category. Typically, these dark tobaccos are air cured and possibly fermented. From a sensorial perspective, dark tobacco is a tobacco type which, after curing, is associated with a smoky, dark cigar type sensation. Dark tobacco is characterized by a low sugar to nitrogen ratio. Examples for dark tobacco are Burley Malawi or other African Burley, Dark Cured Brazil Galpao, Sun Cured or Air Cured Indonesian Kasturi. According to the invention, dark tobaccos are tobaccos with a content of reducing sugars of less than about 5 percent of dry weight base of the leaf and a total ammonia content of up to about 0.5 percent of dry weight base of the leaf.

Aromatic tobaccos are tobaccos that often have small, light coloured leaves. Throughout the specification, the term "aromatic tobacco" is used for other tobaccos that have a high aromatic content, e.g. of essential oils. From a sensorial perspective, aromatic tobacco is a tobacco type which, after curing, is associated with spicy and aromatic sensation. Example for aromatic tobaccos are Greek Oriental, Oriental Turkey, semi-oriental tobacco but also Fire Cured, US Burley, such as Perique, *Rustica*, US Burley or Meriland. Filler tobacco is not a specific tobacco type, but it includes tobacco types which are mostly used to complement the other tobacco types used in the blend and do not bring a specific characteristic aroma direction to the final product. Examples for filler tobaccos are stems, midrib or stalks of other tobacco types. A specific example may be flue cured stems of Flue Cure Brazil lower stalk.

The cut filler suitable to be used with the present invention generally may resemble cut filler used for conventional smoking articles. The cut width of the cut filler preferably is between 0.3 millimetres and 2.0 millimetres, more preferably, the cut width of the cut filler is between 0.5 millimetres and 1.2 millimetres and most preferably, the cut width of the cut filler is between 0.6 millimetres and 0.9 millimetres. The cut width may play a role in the distribution of heat inside the rod of aerosol-generating substrate. Also, the cut width may play a role in the resistance to draw of the article. Further, the cut width may impact the overall density of the aerosol-generating substrate as a whole.

The strand length of the cut-filler is to some extent a random value as the length of the strands will depend on the overall size of the object that the strand is cut off from. Nevertheless, by conditioning the material before cutting, for example by controlling the moisture content and the overall subtlety of the material, longer strands can be cut. Preferably, the strands have a length of between about 10 millimetres and about 40 millimetres before the strands are collated to form the rod of aerosol-generating substrate. Obviously, if the strands are arranged in a rod of aerosol-generating substrate in a longitudinal extension where the longitudinal extension of the section is below 40 millimetres, the final rod of aerosol-generating substrate may comprise strands that are on average shorter than the initial strand length. Preferably, the strand length of the cut-filler is such that between about 20 percent and 60 percent of the strands extend along the full length of the rod of aerosol-generating substrate. This prevents the strands from dislodging easily from the rod of aerosol-generating substrate.

In preferred embodiments, the weight of the cut filler is between 80 milligrams and 400 milligrams, preferably between 150 milligrams and 250 milligrams, more preferably between 170 milligrams and 220 milligrams. This amount of cut filler typically allows for sufficient material for the formation of an aerosol. Additionally, in the light of the aforementioned constraints on diameter and size, this allows for a balanced density of the rod of aerosol-generating substrate between energy uptake, resistance to draw and fluid passageways within the rod of aerosol-generating substrate where the aerosol-generating substrate comprises plant material.

Preferably, the cut filler is soaked with aerosol former. Soaking the cut filler can be done by spraying or by other suitable application methods. The aerosol former may be applied to the blend during preparation of the cut filler. For example, the aerosol former may be applied to the blend in the direct conditioning casing cylinder (DCCC). Conventional machinery can be used for applying an aerosol former to the cut filler. The aerosol former may be any suitable known compound or mixture of compounds that, in use, facilitates formation of a dense and stable aerosol. The aerosol former may be facilitating that the aerosol is substantially resistant to thermal degradation at temperatures typically applied during use of the aerosol-generating article. Suitable aerosol formers are for example to: polyhydric alcohols such as, for example, triethylene glycol, 1,3-butanediol, propylene glycol and glycerine; esters of polyhydric alcohols such as, for example, glycerol mono-, di- or triacetate; aliphatic esters of mono-, di- or polycarboxylic acids such as, for example, dimethyl dodecanedioate and dimethyl tetradecanedioate; and combinations thereof.

Preferably, the aerosol former comprises one or more of glycerine and propylene glycol. The aerosol former may consist of glycerine or propylene glycol or of a combination of glycerine and propylene glycol.

Preferably, the amount of aerosol former is at least 5 percent by weight on a dry weight basis, preferably between 10 percent and 22 percent by weight on a dry weight basis of the cut filler, more preferably, the amount of aerosol former is between 12 percent and 19 percent by weight on a dry weight basis of the cut filler, for example the amount of aerosol former is between 13 percent and 16 percent by weight on a dry weight basis of the cut filler. When aerosol former is added to the cut filler in the amounts described above, the cut filler may become relatively sticky. This advantageously help retain the cut filler at a predetermined location within the article, as the particles of cut filler display a tendency to adhere to surrounding cut filler particles as well as to surrounding surfaces (for example, the internal surface of a wrapper circumscribing the cut filler).

For some embodiments the amount of aerosol former has a target value of about 13 percent by weight on a dry weight basis of the cut filler. The most efficient amount of aerosol former will depend also on the cut filler, whether the cut filler comprises plant lamina or homogenized plant material. For example, among other factors, the type of cut filler will determine to which extent the aerosol-former can facilitate the release of substances from the cut filler.

For these reasons, a rod of aerosol-generating substrate comprising cut filler as described above is capable of efficiently generating sufficient amount of aerosol at relatively low temperatures. A temperature of between 150 degrees Celsius and 200 degrees Celsius in the heating chamber may be sufficient for one such cut filler to generate sufficient amounts of aerosol while in aerosol-generating devices using tobacco cast leave sheets typically temperatures of about 250 degrees Celsius are employed.

A further advantage connected with operating at lower temperatures is that there is a reduced need to cool down the aerosol. As generally low temperatures are used, a simpler cooling function may be sufficient. This in turn allows using a simpler and less complex structure of the aerosol-generating article.

In other preferred embodiments, the aerosol-generating substrate comprises homogenised plant material, preferably a homogenised tobacco material.

As used herein, the term "homogenised plant material" encompasses any plant material formed by the agglomeration of particles of plant. For example, sheets or webs of homogenised tobacco material for the aerosol-generating substrates of the present invention may be formed by agglomerating particles of tobacco material obtained by pulverising, grinding or comminuting plant material and optionally one or more of tobacco leaf lamina and tobacco leaf stems. The homogenised plant material may be produced by casting, extrusion, paper making processes or other any other suitable processes known in the art.

The homogenised plant material can be provided in any suitable form.

In some embodiments, the homogenised plant material may be in the form of one or more sheets. As used herein with reference to the invention, the term "sheet" describes a laminar element having a width and length substantially greater than the thickness thereof.

The homogenised plant material may be in the form of a plurality of pellets or granules.

The homogenised plant material may be in the form of a plurality of strands, strips or shreds. As used herein, the term "strand" describes an elongate element of material having a length that is substantially greater than the width and thickness thereof. The term "strand" should be considered to encompass strips, shreds and any other homogenised plant material having a similar form. The strands of homogenised plant material may be formed from a sheet of homogenised plant material, for example by cutting or shredding, or by other methods, for example, by an extrusion method.

In some embodiments, the strands may be formed in situ within the aerosol-generating substrate as a result of the splitting or cracking of a sheet of homogenised plant material during formation of the aerosol-generating substrate, for example, as a result of crimping. The strands of homogenised plant material within the aerosol-generating substrate may be separate from each other. Alternatively, each strand of homogenised plant material within the aerosol-generating substrate may be at least partially connected to an adjacent strand or strands along the length of the strands. For example, adjacent strands may be connected by one or more fibres. This may occur, for example, where the strands have been formed due to the splitting of a sheet of homogenised plant material during production of the aerosol-generating substrate, as described above.

Where the homogenised plant material is in the form of one or more sheets, as described above, the sheets may be produced by a casting process. Alternatively, sheets of homogenised plant material may be produced by a paper-making process.

The one or more sheets as described herein may each individually have a thickness of between 100 micrometres and 600 micrometres, preferably between 150 micrometres and 300 micrometres, and most preferably between 200 micrometres and 250 micrometres. Individual thickness refers to the thickness of the individual sheet, whereas combined thickness refers to the total thickness of all sheets that make up the aerosol-generating substrate. For example, if the aerosol-generating substrate is formed from two individual sheets, then the combined thickness is the sum of the thickness of the two individual sheets or the measured thickness of the two sheets where the two sheets are stacked in the aerosol-generating substrate.

The one or more sheets as described herein may each individually have a grammage of between about 100 grams per square metre and about 600 grams per square metre.

The one or more sheets as described herein may each individually have a density of from about 0.3 grams per cubic centimetre to about 1.3 grams per cubic centimetre, and preferably from about 0.7 grams per cubic centimetre to about 1.0 gram per cubic centimetre.

In embodiments of the present invention in which the aerosol-generating substrate comprises one or more sheets of homogenised plant material, the sheets are preferably in the form of one or more gathered sheets. As used herein, the term "gathered" denotes that the sheet of homogenised plant material is convoluted, folded, or otherwise compressed or constricted substantially transversely to the cylindrical axis of a plug or a rod.

The one or more sheets of homogenised plant material may be gathered transversely relative to the longitudinal axis thereof and circumscribed with a wrapper to form a continuous rod or a plug.

The one or more sheets of homogenised plant material may advantageously be crimped or similarly treated. As used herein, the term "crimped" denotes a sheet having a plurality of substantially parallel ridges or corrugations. The one or more sheets of homogenised plant material may be embossed, debossed, perforated or otherwise deformed to provide texture on one or both sides of the sheet.

Preferably, each sheet of homogenised plant material may be crimped such that it has a plurality of ridges or corrugations substantially parallel to the cylindrical axis of the plug. This treatment advantageously facilitates gathering of the crimped sheet of homogenised plant material to form the plug. Preferably, the one or more sheets of homogenised plant material may be gathered. It will be appreciated that crimped sheets of homogenised plant material may alternatively or in addition have a plurality of substantially parallel ridges or corrugations disposed at an acute or obtuse angle to the cylindrical axis of the plug. The sheet may be crimped to such an extent that the integrity of the sheet becomes disrupted at the plurality of parallel ridges or corrugations causing separation of the material, and results in the formation of shreds, strands or strips of homogenised plant material.

Alternatively, the one or more sheets of homogenised plant material may be cut into strands as referred to above. In such embodiments, the aerosol-generating substrate comprises a plurality of strands of the homogenised plant material. The strands may be used to form a plug. Typically, the width of such strands is about 5 millimetres, or about 4 millimetres, or about 3 millimetres, or about 2 millimetres or less. The length of the strands may be greater than about 5 millimetres, between about 5 millimetres to about 15 millimetres, about 8 millimetres to about 12 millimetres, or about 12 millimetres. Preferably, the strands have substantially the same length as each other.

The homogenised plant material may comprise up to about 95 percent by weight of plant particles, on a dry weight basis. Preferably, the homogenised plant material comprises up to about 90 percent by weight of plant particles, more preferably up to about 80 percent by weight of plant particles, more preferably up to about 70 percent by weight of plant particles, more preferably up to about 60 percent by weight of plant particles, more preferably up to about 50 percent by weight of plant particles, on a dry weight basis.

For example, the homogenised plant material may comprise between about 2.5 percent and about 95 percent by weight of plant particles, or about 5 percent and about 90 percent by weight of plant particles, or between about 10 percent and about 80 percent by weight of plant particles, or between about 15 percent and about 70 percent by weight of plant particles, or between about 20 percent and about 60 percent by weight of plant particles, or between about 30 percent and about 50 percent by weight of plant particles, on a dry weight basis.

In certain embodiments of the invention, the homogenised plant material is a homogenised tobacco material comprising tobacco particles. Sheets of homogenised tobacco material for use in such embodiments of the invention may have a tobacco content of at least about 40 percent by weight on a dry weight basis, more preferably of at least about 50 percent by weight on a dry weight basis more preferably at least about 70 percent by weight on a dry weight basis and most preferably at least about 90 percent by weight on a dry weight basis.

With reference to the present invention, the term "tobacco particles" describes particles of any plant member of the genus *Nicotiana*. The term "tobacco particles" encompasses ground or powdered tobacco leaf lamina, ground or powdered tobacco leaf stems, tobacco dust, tobacco fines, and other particulate tobacco by-products formed during the treating, handling and shipping of tobacco. In a preferred embodiment, the tobacco particles are substantially all derived from tobacco leaf lamina. By contrast, isolated nicotine and nicotine salts are compounds derived from tobacco but are not considered tobacco particles for purposes of the invention and are not included in the percentage of particulate plant material.

The homogenised plant material may further comprise one or more aerosol formers. Upon volatilisation, an aerosol former can convey other vaporised compounds released from the aerosol-generating substrate upon heating, such as nicotine and flavourants, in an aerosol. Suitable aerosol formers for inclusion in the homogenised plant material are known in the art and include, but are not limited to: polyhydric alcohols, such as triethylene glycol, propylene glycol, 1,3-butanediol and glycerol; esters of polyhydric alcohols, such as glycerol mono-, di- or triacetate; and aliphatic esters of mono-, di- or polycarboxylic acids, such as dimethyl dodecanedioate and dimethyl tetradecanedioate.

The homogenised plant material may have an aerosol former content of between about 5 percent and about 30 percent by weight on a dry weight basis, such as between about 10 percent and about 25 percent by weight on a dry weight basis, or between about 15 percent and about 20 percent by weight on a dry weight basis. The aerosol former may act as a humectant in the homogenised plant material.

As set out above, the rod of aerosol-generating substrate may be circumscribed by a wrapper. The wrapper circumscribing the rod of aerosol-generating substrate may be a paper wrapper or a non-paper wrapper. Suitable paper wrappers for use in specific embodiments of the invention are known in the art and include, but are not limited to: cigarette papers; and filter plug wraps. Suitable non-paper wrappers for use in specific embodiments of the invention are known in the art and include, but are not limited to sheets of homogenised tobacco materials.

A paper wrapper may have a grammage of at least 15 gsm, preferably at least 20 gsm. The paper wrapper may have a grammage of less than or equal to 35 gsm, preferably less than or equal to 30 gsm. The paper wrapper may have a grammage from 15 gsm to 35 gsm, preferably from 20 gsm to 30 gsm. In a preferred embodiment, the paper wrapper may have a grammage of 25 gsm. A paper wrapper may have a thickness of at least 25 micrometres, preferably at least 30 micrometres, more preferably at least 35 micrometres. The paper wrapper may have a thickness of less than or equal to 55 micrometres, preferably less than or equal to 50 micrometres, more preferably less than or equal to 45 micrometres. The paper wrapper may have a thickness from 25 micrometres to 55 micrometres, preferably from 30 micrometres to 50 micrometres, more preferably from 35 micrometres to 45 micrometres. In a preferred embodiment, the paper wrapper may have a thickness of 40 microns.

In certain preferred embodiments, the wrapper may be formed of a laminate material comprising a plurality of layers. Preferably, the wrapper is formed of an aluminium co-laminated sheet. The use of a co-laminated sheet comprising aluminium advantageously prevents combustion of the aerosol-generating substrate in the event that the aerosol-generating substrate should be ignited, rather than heated in the intended manner.

A paper layer of the co-laminated sheet may have a grammage of at least 35 gsm, preferably at least 40 gsm. The paper layer of the co-laminated sheet may have a grammage of less than or equal to 55 gsm, preferably less than or equal to 50 gsm. The paper layer of the co-laminated sheet may have a grammage from 35 gsm to 55 gsm, preferably from 40 gsm to 50 gsm. In a preferred embodiment, the paper layer of the co-laminated sheet may have a grammage of 45 gsm.

A paper layer of the co-laminated sheet may have a thickness of at least 50 micrometres, preferably at least 55 micrometres, more preferably at least 60 micrometres. The paper layer of the co-laminated sheet may have a thickness of less than or equal to 80 micrometres, preferably less than or equal to 75 micrometres, more preferably less than or equal to 70 micrometres.

The paper layer of the co-laminated sheet may have a thickness from 50 micrometres to 80 micrometres, preferably from 55 micrometres to 75 micrometres, more preferably from 60 micrometres to 70 micrometres. In a preferred embodiment, the paper layer of the co-laminated sheet may have a thickness of 65 microns.

A metallic layer of the co-laminated sheet may have a grammage of at least 12 gsm, preferably at least 15 gsm. The metallic layer of the co-laminated sheet may have a grammage of less than or equal to 25 gsm, preferably less than or equal to 20 gsm. The metallic layer of the co-laminated sheet may have a grammage from 12 gsm to 25 gsm, preferably from 15 gsm to 20 gsm. In a preferred embodiment, the metallic layer of the co-laminated sheet may have a grammage of 17 gsm.

A metallic layer of the co-laminated sheet may have a thickness of at least 2 micrometres, preferably at least 3 micrometres, more preferably at least 5 micrometres. The metallic layer of the co-laminated sheet may have a thickness of less than or equal to 15 micrometres, preferably less than or equal to 12 micrometres, more preferably less than or equal to 10 micrometres.

The metallic layer of the co-laminated sheet may have a thickness from 2 micrometres to 15 micrometres, preferably from 3 micrometres to 12 micrometres, more preferably from 5 micrometres to 10 micrometres. In a preferred embodiment, the metallic layer of the co-laminated sheet may have a thickness of 6 microns.

The wrapper circumscribing the rod of aerosol-generating substrate may be a paper wrapper comprising PVOH (polyvinyl alcohol) or silicon. Addition of PVOH (polyvinyl alcohol) or silicon may improve the grease barrier properties of the wrapper.

The PVOH or silicon may be applied to the paper layer as a surface coating, such as disposed on an exterior surface of the paper layer of the wrapper circumscribing the rod of aerosol-generating substrate. The PVOH or silicon may be disposed on and form a layer on the exterior surface of the paper layer of the wrapper. The PVOH or silicon may be disposed on an interior surface of the paper layer of the wrapper. The PVOH or silicon may be disposed on and form a layer on the interior surface of the paper layer of the aerosol generating article. The PVOH or silicon may be disposed on the interior surface and the exterior surface of the paper layer of the wrapper. The PVOH or silicon may be disposed on and form a layer on the interior surface and the exterior surface of the paper layer of the wrapper.

The paper wrapper comprising PVOH or silicon may have a grammage of at least 20 gsm, preferably at least 25 gsm, more preferably at least 30 gsm. The paper wrapper comprising PVOH or silicon may have a grammage of less than or equal to 50 gsm, preferably less than or equal to 45 gsm, more preferably less than or equal to 40 gsm. The paper wrapper comprising PVOH or silicon may have a grammage from 20 gsm to 50 gsm, preferably from 25 gsm to 45 gsm, more preferably from 30 gsm to 40 gsm. In particularly preferred embodiments, the paper wrapper comprising PVOH or silicon may have a grammage of about 35 gsm.

The paper wrapper comprising PVOH or silicon may have a thickness of at least 25 micrometres, preferably at least 30 micrometres, more preferably at least 35 micrometres. The paper wrapper comprising PVOH or silicon may have a thickness of less than or equal to 50 micrometres, preferably less than or equal to 45 micrometres, more preferably less than or equal to 40 micrometres. The paper wrapper comprising PVOH or silicon may have a thickness from 25 micrometres to 50 micrometres, preferably from 30 micrometres to 45 micrometres, more preferably from 35 micrometres to 40 micrometres. In particularly preferred embodiments, the paper wrapper comprising PVOH or silicon may have a thickness of 37 micrometres.

The wrapper circumscribing the rod of aerosol-generating substrate may comprise a flame retardant composition comprising one or more flame retardant compounds. The term "flame retardant compounds" is used herein to describe chemical compounds that, when added to or otherwise incorporated into a carrier substrate, such as paper or plastic compounds, provide the carrier substrate with varying degrees of flammability protection. In practice, flame retardant compounds may be activated by the presence of an ignition source and are adapted to prevent or slow the further development of ignition by a variety of different physical and chemical mechanisms.

A flame retardant composition may typically further comprise one of more non-flame retardant compounds, that is, one or more compound—such as a solvent, an excipient, a filler—that does not actively contribute to providing the carrier substrate with flammability protection, but is used to facilitate the application of the flame retardant compound or compounds onto or into the wrapper or both. Some of the non-flame retardant compounds of a flame retardant composition—such as solvents—are volatile and may evaporate from the wrapper upon drying after the flame retardant composition has been applied onto or into the wrapping base material or both. As such, although such non-flame retardant compounds form part of the formulation of the flame retardant composition, they may no longer be present or they may only be detectable in trace amounts in the wrapper of an aerosol-generating article.

A number of suitable flame retardant compounds are known to the skilled person. In particular, several flame retardant compounds and formulations suitable for treating cellulosic materials are known and have been disclosed and may find use in the manufacture of wrappers for aerosol-generating articles in accordance with the present invention.

For example, the flame retardant composition may comprise a polymer and a mixed salt based on at least one mono, di- and/or tri-carboxylic acid, at least one polyphosphoric, pyrophosphoric and/or phosphoric acid, and a hydroxide or a salt of an alkali or an alkaline earth metal, where the at least one mono, di- and/or tri-carboxylic acid and the hydroxide or salt form a carboxylate and the at least one polyphosphoric, pyrophosphoric and/or phosphoric acid and the hydroxide or salt form a phosphate. Preferably, the flame retardant composition may further comprise a carbonate of an alkali or an alkaline earth metal. Alternatively, the flame retardant composition may comprise cellulose modified with at least one C10 or higher fatty acid, tall oil fatty acid (TOFA), phosphorylated linseed oil, phosphorylated downstream corn oil. Preferably, the at least one C10 or higher fatty acid is selected from the group consisting of capric acid, myristic acid, palmitic acid, and combinations thereof.

In a wrapper comprising a flame retardant composition suitable for use in an aerosol-generating article in accordance with the present invention, the flame retardant composition may be provided in a treated portion of the wrapper. This means that the flame retardant composition has been applied onto or into a corresponding portion of a wrapping base material of the wrapper or both. Thus, in the treated portion, the wrapper has an overall dry basis weight that is greater than the dry basis weight of the wrapping base material. The treated portion of the wrapper may extend over at least about 10 percent of an outer surface area of the rod of aerosol-generating substrate circumscribed by the wrapper, preferably over at least about 20 percent of an outer surface area of the rod of aerosol-generating substrate circumscribed by the wrapper, more preferably over at least about 40 percent of an outer surface area of the rod of aerosol-generating substrate, even more preferably over at least about 60 percent of an outer surface area of the rod of aerosol-generating substrate. Most preferably, the treated portion of the wrapper extends over at least about 80 percent of an outer surface area of the rod of aerosol-generating substrate. In particularly preferred embodiments, the treated portion of the wrapper extends over at least about 90 or even 95 percent of an outer surface area of the rod of aerosol-generating substrate. Most preferably, the treated portion of the wrapper extends substantially over the entire outer surface area of the rod of aerosol-generating substrate.

The wrapper comprising a flame retardant composition may have a grammage of at least 20 gsm, preferably at least 25 gsm, more preferably at least 30 gsm. The wrapper comprising a flame retardant composition may have a grammage of less than or equal to 45 gsm, preferably less than or equal to 40 gsm, more preferably less than or equal to 35 gsm. The wrapper comprising a flame retardant composition may have a grammage from 20 gsm to 45 gsm, preferably from 25 gsm to 40 gsm, more preferably from 30 gsm to 35 gsm. In some preferred embodiments, the wrapper comprising a flame retardant composition may have a grammage of 33 gsm.

The wrapper comprising a flame retardant composition may have a thickness of at least 25 micrometres, preferably at least 30 micrometres, even more preferably 35 micrometres. The wrapper comprising a flame retardant composition may have a thickness of less than or equal to 50 micrometres, preferably less than or equal to 45 micrometres, even more preferably less than or equal to 40 micrometres. In some embodiments, the wrapper comprising a flame retardant composition may have a thickness of 37 micrometres.

An aerosol-generating article according to the present disclosure preferably comprises an upstream section located upstream of the rod of aerosol-generating substrate. The upstream section is preferably located immediately upstream of the rod of aerosol-generating substrate. The upstream section preferably extends between the upstream end of the aerosol-generating article and the rod of aerosol-generating substrate. The upstream section may comprise one or more upstream elements located upstream of the rod of aerosol-generating substrate. Such one or more upstream elements are described within the present disclosure. The aerosol-generating articles of the present invention preferably comprise an upstream element located upstream of and adjacent to the aerosol-generating substrate. The upstream element advantageously prevents direct physical contact with the upstream end of the aerosol-generating substrate. For example, where the aerosol-generating substrate comprises a susceptor element, the upstream element may prevent direct physical contact with the upstream end of the susceptor element. This helps to prevent the displacement or deformation of the susceptor element during handling or transport of the aerosol-generating article. This in turn helps to secure the form and position of the susceptor element. Furthermore, the presence of an upstream element helps to prevent any loss of the substrate, which may be advantageous, for example, if the substrate contains particulate plant material.

Where the aerosol-generating substrate comprises shredded tobacco, such as tobacco cut filler, the upstream section or element thereof may additionally help to prevent the loss of loose particles of tobacco from the upstream end of the article.

The upstream section, or upstream element thereof, may also additionally provide a degree of protection to the aerosol-generating substrate during storage, as it covers at least to some extent the upstream end of the aerosol-generating substrate, which may otherwise be exposed.

For aerosol-generating articles that are intended to be inserted into a cavity in an aerosol-generating device such that the aerosol-generating substrate can be externally heated within the cavity, the upstream section, or upstream element thereof, may advantageously facilitate the insertion of the upstream end of the article into the cavity. The inclusion of the upstream element may additionally protect the end of the rod of aerosol-generating substrate during the insertion of the article into the cavity such that the risk of damage to the substrate is minimised.

The upstream section, or upstream element thereof, may also provide an improved appearance to the upstream end of the aerosol-generating article. Furthermore, if desired, the upstream section, or upstream element thereof, may be used to provide information on the aerosol-generating article, such as information on brand, flavour, content, or details of the aerosol-generating device that the article is intended to be used with.

An upstream element may be a porous plug element. Preferably, an upstream element has a porosity of at least about 50 percent in the longitudinal direction of the aerosol-generating article. More preferably, an upstream element has a porosity of between about 50 percent and about 90 percent in the longitudinal direction. The porosity of an upstream element in the longitudinal direction is defined by the ratio of the cross-sectional area of material forming the upstream element and the internal cross-sectional area of the aerosol-generating article at the position of the upstream element.

An upstream element may be made of a porous material or may comprise a plurality of openings. This may, for example, be achieved through laser perforation. Preferably, the plurality of openings is distributed homogeneously over the cross-section of the upstream element.

The porosity or permeability of an upstream element may advantageously be designed in order to provide an aerosol-generating article with a particular overall resistance to draw (RTD) without substantially impacting the filtration provided by other portions of the article.

An upstream element may be formed from a material that is impermeable to air. In such embodiments, the aerosol-generating article may be configured such that air flows into the rod of aerosol-generating substrate through suitable ventilation means provided in a wrapper.

In certain preferred embodiments of the invention, it may be desirable to minimise the RTD of an upstream element. For example, this may be the case for articles that are intended to be inserted the cavity of an aerosol-generating device such that the aerosol-generating substrate is externally heated, as described herein. For such articles, it is desirable to provide the article with as low an RTD as possible, so that the majority of the RTD experience by the consumer is provided by the aerosol-generating device and not the article.

The RTD of an upstream element is preferably less than or equal to about 10 millimetres $H_2O$. More preferably, the RTD of an upstream element is less than or equal to about 5 millimetres $H_2O$. Even more preferably, the RTD of an upstream element is less than or equal to about 2.5 millimetres $H_2O$. Even more preferably, the RTD of the upstream element is less than or equal to about 2 millimetres $H_2O$.

The RTD of an upstream element may be at least 0.1 millimetres $H_2O$, or at least about 0.25 millimetres $H_2O$ or at least about 0.5 millimetres $H_2O$.

In some embodiments, the RTD of an upstream element is from about 0.1 millimetres $H_2O$ to about 10 millimetres $H_2O$, preferably from about 0.25 millimetres $H_2O$ to about 10 millimetres $H_2O$, preferably from about 0.5 millimetres $H_2O$ to about 10 millimetres $H_2O$. In other embodiments, the RTD of an upstream element is from about 0.1 millimetres $H_2O$ to about 5 millimetres $H_2O$, preferably from about 0.25 millimetres $H_2O$ to about 5 millimetres $H_2O$ preferably from about 0.5 millimetres $H_2O$ to about 5 millimetres $H_2O$. In further embodiments, the RTD of an upstream element is from about 0.1 millimetres $H_2O$ to about 2.5 millimetres $H_2O$, preferably from about 0.25 millimetres $H_2O$ to about 2.5 millimetres $H_2O$, more preferably from about 0.5 millimetres $H_2O$ to about 2.5 millimetres $H_2O$. In further embodiments, the RTD of an upstream element is from about 0.1 millimetres $H_2O$ to about 2 millimetres $H_2O$, preferably from about 0.25 millimetres $H_2O$ to about 2 millimetres $H_2O$, more preferably from about 0.5 millimetres $H_2O$ to about 2 millimetres $H_2O$. In a particularly preferred embodiment, the RTD of an upstream element is about 1 millimeter $H_2O$.

Preferably, an upstream element has an RTD of less than about 2 millimetres $H_2O$ per millimeter of length, more preferably less than about 1.5 millimetres $H_2O$ per millimeter of length, more preferably less than about 1 millimeter $H_2O$ per millimeter of length, more preferably less than about 0.5 millimetres $H_2O$ per millimeter of length, more preferably less than about 0.3 millimetres $H_2O$ per millimeter of length, more preferably less than about 0.2 millimetres $H_2O$ per millimeter of length.

Preferably, the combined RTD of the upstream section, or upstream element thereof, and the rod of aerosol-generating substrate is less than about 15 millimetres $H_2O$, more preferably less than about 12 millimetres $H_2O$, more preferably less than about 10 millimetres $H_2O$.

In particularly preferred embodiments, an upstream element is formed of a hollow tubular segment defining a longitudinal cavity providing an unrestricted flow channel. In such embodiments, an upstream element can provide protection for the aerosol-generating substrate, as described above, whilst having a minimal effect on the overall resistance to draw (RTD) and filtration properties of the article.

Preferably, the diameter of the longitudinal cavity of the hollow tubular segment forming an upstream element is at least about 4 millimetres, more preferably at least about 4.5 millimetres, more preferably at least about 5 millimetres and more preferably at least about 5.5 millimetres. Preferably, the diameter of the longitudinal cavity is maximised in order to minimise the RTD of the upstream section, or upstream element thereof. An internal diameter of the upstream element may be about 5.1 mm.

Preferably, the wall thickness of the hollow tubular segment is less than about 2 millimetres, more preferably less than about 1.5 millimetres and more preferably less than about 1.25 millimetres. The wall thickness of the hollow tubular segment defining an upstream element may about 1 mm.

An upstream element of the upstream section may be made of any material suitable for use in an aerosol-generating article. The upstream element may, for example, be made of a same material as used for one of the other components of the aerosol-generating article, such as the mouthpiece, the cooling element or the support element. Suitable materials for forming the upstream element include filter materials, ceramic, polymer material, cellulose acetate, cardboard, zeolite or aerosol-generating substrate. The upstream element may comprise a plug of cellulose acetate. The upstream element may comprise a hollow acetate tube, or a cardboard tube.

Preferably, an upstream element is formed of a heat resistant material. For example, preferably an upstream element is formed of a material that resists temperatures of up to 350 degrees Celsius. This ensures that an upstream element is not adversely affected by the heating means for heating the aerosol-generating substrate.

Preferably, the upstream section, or an upstream element thereof, has an external diameter that is approximately equal to the external diameter of the aerosol-generating article. Preferably, the external diameter of the upstream section, or an upstream element thereof, is between about 6 millimetres and about 8 millimetres, more preferably between about 7 millimetres and about 7.5 millimetres. Preferably, the upstream section or an upstream element has an external diameter that is about 7.1 mm.

Preferably, the upstream section or an upstream element has a length of between about 2 millimetres and about 8 millimetres, more preferably between about 3 millimetres and about 7 millimetres, more preferably between about 4 millimetres and about 6 millimetres. In a particularly preferred embodiment, the upstream section or an upstream element has a length of about 5 millimetres. The length of the upstream section or an upstream element can advantageously be varied in order to provide the desired total length of the aerosol-generating article. For example, where it is desired to reduce the length of one of the other components of the aerosol-generating article, the length of the upstream section or an upstream element may be increased in order to maintain the same overall length of the article.

In addition, the length of the upstream section, or an upstream element thereof, can be used to control the position of the aerosol-generating article within the cavity of an aerosol-generating device, for articles which are intended to be externally heated. This can advantageously ensure that the position of the aerosol-generating substrate within the cavity can be optimised for heating and the position of any ventilation can also be optimised.

The upstream section is preferably circumscribed by a wrapper, such as a plug wrap. The wrapper circumscribing the upstream section is preferably a stiff plug wrap, for example, a plug wrap having a basis weight of at least about 80 grams per square metre (gsm), or at least about 100 gsm, or at least about 110 gsm. This provides structural rigidity to the upstream section.

The upstream section is preferably connected to the rod of aerosol-generating substrate and optionally to at least a part of the downstream section by means of an outer wrapper, as described herein.

As mentioned above, an aerosol-generating article according to the present invention comprises a downstream section located downstream of the rod of aerosol-generating substrate. The downstream section is preferably located immediately downstream of the rod of aerosol-generating substrate. The downstream section of the aerosol-generating article preferably extends between the rod of aerosol-generating substrate and the downstream end of the aerosol-generating article. The downstream section may comprise one or more elements, each of which will be described in more detail within the present disclosure.

A length of the downstream section may be at least about 20 mm. A length of the downstream section may be at least about 24 mm. A length of the downstream section may be at least about 26 mm.

A length of the downstream section may be equal to or less than (in other words, may be no more than) about 36 mm. A length of the downstream section may be equal to or less than about 32 mm. A length of the downstream section may be equal to or less than about 30 mm.

A length of the downstream section may be between about 20 mm and about 36 mm. A length of the downstream section may be between about 24 mm and about 32 mm. A length of the downstream section may be between about 26 mm and about 30 mm.

Preferably, the downstream section comprises a hollow tubular element. Preferably, the downstream section comprises a mouthpiece element. In preferred embodiments of the present invention, the downstream section comprises, or consists of, a hollow tubular element and a mouthpiece element, the hollow tubular element being located between the rod of aerosol-generating substrate and the mouthpiece element.

In embodiments where the downstream section comprises a hollow tubular element and a mouthpiece element, a combined or total length of the hollow tubular element and the mouthpiece element may be at least about 20 mm. In other words, the sum of the lengths of the hollow tubular element and the mouthpiece element may be at least about 20 mm. A combined length of the hollow tubular element and the mouthpiece element may be at least about 24 mm. A combined length of the hollow tubular element and the mouthpiece element may be at least about 26 mm.

A combined length of the hollow tubular element and the mouthpiece element may be equal to or less than about 36 mm. A combined length of the hollow tubular element and the mouthpiece element may be equal to or less than about 32 mm. A combined length of the hollow tubular element and the mouthpiece element may be equal to or less than about 30 mm.

A combined length of the hollow tubular element and the mouthpiece element may be between about 20 mm and about 36 mm. A combined length of the hollow tubular element and the mouthpiece element may be between about 24 mm and about 32 mm. A combined length of the hollow tubular element and the mouthpiece element may be between about 26 mm and about 30 mm.

Preferably, a combined length of the hollow tubular element and the mouthpiece element may be about 28 mm.

In embodiments where the downstream section consists of a hollow tubular element and a mouthpiece element, the length of the downstream section is defined by the combined length of the hollow tubular element and the mouthpiece element.

Providing a relatively long downstream section, which may be defined by a relatively long combination of the hollow tubular element and the mouthpiece element, ensures that a suitable length of the aerosol-generating article protrudes from an aerosol-generating device when the article is received therein. Such a suitable protrusion length facilitates the ease of insertion and extraction of the article from the device, which also ensures that the upstream portions of the article are suitably inserted into the device with reduced risk of damage, particularly during insertion.

A ratio between a length of the downstream section and an overall length of the aerosol-generating article may be less than or equal to about 0.80. Preferably, a ratio between a length of the downstream section and an overall length of the aerosol-generating article may be less than or equal to about 0.75. More preferably, a ratio between a length of the downstream section and an overall length of the aerosol-generating article may be less than or equal to about 0.70. Even more preferably, a ratio between a length of the downstream section and an overall length of the aerosol-generating article may be less than or equal to about 0.65.

A ratio between a length of the downstream section and an overall length of the aerosol-generating article may be at least about 0.30. Preferably, a ratio between a length of the downstream section and an overall length of the aerosol-generating article may be at least about 0.40. More preferably, a ratio between a length of the downstream section and an overall length of the aerosol-generating article may be at least about 0.50. Even more preferably, a ratio between a length of the downstream section and an overall length of the aerosol-generating article may be at least about 0.60.

In some embodiments, a ratio between a length of the downstream section and an overall length of the aerosol-generating article is from about 0.30 to about 0.80, preferably from about 0.40 to about 0.80, more preferably from about 0.50 to about 0.80, even more preferably from about 0.60 to about 0.80. In other embodiments, a ratio between a length of the downstream section and an overall length of the aerosol-generating article is from about 0.30 to about 0.75, preferably from about 0.40 to about 0.75, more preferably from about 0.50 to about 0.75, even more preferably from about 0.60 to about 0.75. In further embodiments, a ratio between a length of the downstream section and an overall length of the aerosol-generating article is from about 0.30 to about 0.70, preferably from about 0.40 to about 0.70, more preferably from about 0.50 to about 0.70, even more preferably from about 0.60 to about 0.70. By way of example, a ratio between a length of the downstream section and an overall length of the aerosol-generating article may between about 0.60 and 0.65, more preferably a ratio between a length of the downstream section and an overall length of the aerosol-generating article may be 0.62.

A ratio between a length of the downstream section and a length of the upstream section may be less than or equal to about 18. Preferably, a ratio between a length of the downstream section and a length of the upstream section may be less than or equal to about 12. More preferably, a ratio between a length of the downstream section and a length of the upstream section may be less than or equal to about 8. Even more preferably, a ratio between a length of the downstream section and a length of the upstream section may be less than or equal to about 6.

A ratio between a length of the downstream section and a length of the upstream section may be at least about 2.5. Preferably, a ratio between a length of the downstream section and a length of the upstream section may be at least about 3. More preferably, a ratio between a length of the downstream section and a length of the upstream section may be at least about 4. Even more preferably, a ratio between a length of the downstream section and a length of the upstream section may be at least about 5.

In some embodiments, a ratio between a length of the downstream section and a length of the upstream section is from about 2.5 to about 18, preferably from about 3 to about 18, more preferably from about 4 to about 18, even more preferably from about 5 to about 18. In other embodiments, a ratio between a length of the downstream section and a length of the upstream section is from about 2.5 to about 12, preferably from about 3 to about 12, more preferably from about 4 to about 12, even more preferably from about 5 to about 12. In further embodiments, a ratio between a length of the downstream section and a length of the upstream section is from about 2.5 to about 8, preferably from about 3 to about 8, more preferably from about 4 to about 8, even more preferably from about 5 to about 8. By way of example, a ratio between a length of the downstream section and a length of the upstream section may be about 6, even more preferably about 5.6.

A ratio between the length of the aerosol-generating element (in other words, the rod of aerosol-generating substrate) and a length of the downstream section may be less than or equal to about 0.80. Preferably, a ratio between a length of the aerosol-generating element and a length of the downstream section may be less than or equal to about 0.70. More preferably, a ratio between a length of the aerosol-generating element and a length of the downstream section may be less than or equal to about 0.60. Even more preferably, a ratio between a length of the aerosol-generating element and a length of the downstream section may be less than or equal to about 0.50.

A ratio between a length of the aerosol-generating element and a length of the downstream section may be at least about 0.20. Preferably, a ratio between a length of the aerosol-generating element and a length of the downstream section may be at least about 0.25. More preferably, a ratio between a length of the aerosol-generating element and a length of the downstream section may be at least about 0.30. Even more preferably, a ratio between a length of the aerosol-generating element and a length of the downstream section may be at least about 0.40.

In some embodiments, a ratio between a length of the aerosol-generating element and a length of the downstream section is from about 0.20 to about 0.80, preferably from about 0.25 to about 0.80, more preferably from about 0.30 to about 0.80, even more preferably from about 0.40 to about 0.80. In other embodiments, a ratio between a length of the aerosol-generating element and a length of the downstream section is from about 0.20 to about 0.70, preferably from about 0.25 to about 0.70, more preferably from about 0.30 to about 0.70, even more preferably from about 0.40 to about 0.70. In further embodiments, a ratio between a length of the aerosol-generating element and a length of the downstream section is from about 0.20 to about 0.60, preferably from about 0.25 to about 0.60, more preferably from about 0.30 to about 0.60, even more preferably from about 0.40 to about 0.60. By way of example, a ratio between a length of the aerosol-generating element and a length of the downstream section may be about 0.5, more preferably about 0.45, even more preferably about 0.43.

The downstream section of an aerosol-generating article according to the present invention may comprise a hollow tubular element. The hollow tubular element is preferably provided downstream of the rod of aerosol-generating substrate. The hollow tubular element may be provided immediately downstream of the rod of aerosol-generating substrate. In other words, the hollow tubular element may abut a downstream end of the rod of aerosol-generating substrate. The hollow tubular element may define an upstream end of the downstream section of the aerosol-generating article. The hollow tubular element may be located between the rod of aerosol-generating substrate and the downstream end of the aerosol-generating article. The downstream end of the aerosol-generating article may coincide with the downstream end of the downstream section. Preferably, the downstream section of the aerosol-generating article comprises a single hollow tubular element. In other words, the downstream section of the aerosol-generating article may comprise only one hollow tubular element.

As used throughout the present disclosure, the terms "hollow tubular segment" or "hollow tubular element" denotes a generally elongate element defining a lumen or airflow passage along a longitudinal axis thereof. In particular, the term "tubular" will be used in the following with reference to a tubular element having a substantially cylindrical cross-section and defining at least one airflow conduit establishing an uninterrupted fluid communication between an upstream end of the tubular element and a downstream end of the tubular element. However, it will be understood that alternative geometries (for example, alternative cross-sectional shapes) of the tubular segment may be possible. The hollow tubular segment or element may be an individual, discrete element of the aerosol-generating article which has a defined length and thickness.

An internal volume defined by the hollow tubular element may be at least about 100 cubic millimetres. In other words, a volume of the cavity or lumen defined by the hollow tubular element may be at least about 100 cubic millimetres. Preferably, an internal volume defined by the hollow tubular element may be at least about 300 cubic millimetres. An internal volume defined by the hollow tubular element may be at least about 700 cubic millimetres.

An internal volume defined by the hollow tubular element may be less than or equal to about 1200 cubic millimetres. Preferably, an internal volume defined by the hollow tubular element may be less than or equal to about 1000 cubic millimetres. An internal volume defined by the hollow tubular element may be less than or equal to about 900 cubic millimetres.

An internal volume defined by the hollow tubular element may be between about 100 and about 1200 cubic millimetres. Preferably, an internal volume defined by the hollow tubular element may be between about 300 and about 1000 cubic millimetres. An internal volume defined by the hollow tubular element may be between about 700 and about 900 cubic millimetres.

In the context of the present invention, a hollow tubular segment provides an unrestricted flow channel. This means that the hollow tubular segment provides a negligible level of resistance to draw (RTD). The term "negligible level of RTD" is used to describe an RTD of less than 1 mm $H_2O$ per 10 millimetres of length of the hollow tubular segment or hollow tubular element, preferably less than 0.4 mm $H_2O$ per 10 millimetres of length of the hollow tubular segment or hollow tubular element, more preferably less than 0.1 mm $H_2O$ per 10 millimetres of length of the hollow tubular segment or hollow tubular element.

The RTD of a hollow tubular element is preferably less than or equal to about 10 millimetres $H_2O$. More preferably, the RTD of a hollow tubular element is less than or equal to about 5 millimetres $H_2O$. Even more preferably, the RTD of a hollow tubular element is less than or equal to about 2.5 millimetres $H_2O$. Even more preferably, the RTD of the hollow tubular element is less than or equal to about 2 millimetres $H_2O$. Even more preferably, the RTD of the hollow tubular element is less than or equal to about 1 millimeter $H_2O$.

The RTD of a hollow tubular element may be at least about 0 millimetres $H_2O$, or at least about 0.25 millimetres $H_2O$ or at least about 0.5 millimetres $H_2O$ or at least about 1 millimeter $H_2O$.

In some embodiments, the RTD of a hollow tubular element is from about 0 millimeter $H_2O$ to about 10 millimetres $H_2O$, preferably from about 0.25 millimetres $H_2O$ to about 10 millimetres $H_2O$, preferably from about 0.5 millimetres $H_2O$ to about 10 millimetres $H_2O$. In other embodiments, the RTD of a hollow tubular element is from about 0 millimetres $H_2O$ to about 5 millimetres $H_2O$, preferably from about 0.25 millimetres $H_2O$ to about 5 millimetres $H_2O$ preferably from about 0.5 millimetres $H_2O$ to about 5 millimetres $H_2O$. In other embodiments, the RTD of a hollow tubular element is from about 1 millimeter $H_2O$ to about 5 millimetres $H_2O$. In further embodiments, the RTD of a hollow tubular element is from about 0 millimetres $H_2O$ to about 2.5 millimetres $H_2O$, preferably from about 0.25 millimetres $H_2O$ to about 2.5 millimetres $H_2O$, more preferably from about 0.5 millimetres $H_2O$ to about 2.5 millimetres $H_2O$. In further embodiments, the RTD of a hollow tubular element is from about 0 millimetres $H_2O$ to about 2 millimetres $H_2O$, preferably from about 0.25 millimetres $H_2O$ to about 2 millimetres $H_2O$, more preferably from about 0.5 millimetres $H_2O$ to about 2 millimetres $H_2O$. In a particularly preferred embodiment, the RTD of a hollow tubular element is about 0 millimeter $H_2O$.

In aerosol-generating articles in accordance with the present invention the overall RTD of the article depends essentially on the RTD of the rod and optionally on the RTD of the mouthpiece and/or upstream elements. This is because the hollow tubular segment is substantially empty and, as such, substantially only marginally contribute to the overall RTD of the aerosol-generating article.

The flow channel should therefore be free from any components that would obstruct the flow of air in a longitudinal direction. Preferably, the flow channel is substantially empty.

In the present specification, a "hollow tubular segment" or "hollow tubular element" may also be referred to as a "hollow tube" or a "hollow tube segment".

The hollow tubular element may comprise one or more hollow tubular segments.

Preferably, the hollow tubular element consists of one (single) hollow tubular segment. Preferably, the hollow tubular element consists of a continuous hollow tubular segment. A hollow tubular segment may comprise any of the features described in the present disclosure in relation to the hollow tubular element.

As will be described in greater detail within the present disclosure, the aerosol-generating article may comprise a ventilation zone at a location along the downstream section. In more detail, the aerosol-generating article may comprise a ventilation zone at a location along the hollow tubular element. Such, or any, ventilation zone may extend through the peripheral wall of the hollow tubular element. As such, fluid communication is established between the flow channel internally defined by the hollow tubular element and the outer environment. The ventilation zone is further described within the present disclosure.

The length of the hollow tubular element may be at least about 15 mm. The length of the hollow tubular element may be at least about 17 mm. The length of the hollow tubular element may be at least about 19 mm.

The length of the hollow tubular element may be less or equal than about 30 mm. The length of the hollow tubular element may be less or equal than about 25 mm. The length of the hollow tubular element may be less or equal than about 23 mm.

The length of the hollow tubular element may be between about 15 mm and 30 mm. The length of the hollow tubular element may be between about 17 mm and 25 mm. The length of the hollow tubular element may be between about 19 mm and 23 mm.

Preferably, the length of the hollow tubular element may be about 21 mm.

A relatively long hollow tubular element provides and defines a relatively long internal cavity within the aerosol-generating article and downstream of the rod of aerosol-generating substrate. As discussed in the present disclosure, providing an empty cavity downstream (preferably, immediately downstream) of the aerosol-generating substrate enhances the nucleation of aerosol particles generated by the substrate. Providing a relatively long cavity maximises such nucleation benefits, thereby improving aerosol formation and cooling.

A ratio between the length of the aerosol-generating element (in other words, the rod of aerosol-generating substrate) and a length of the hollow tubular element may be less than or equal to about 1.25. Preferably, a ratio between a length of the aerosol-generating element and a length of the hollow tubular element may be less than or equal to about 1. More preferably, a ratio between a length of the aerosol-generating element and a length of the hollow tubular element may be less than or equal to about 0.75. Even more preferably, a ratio between a length of the aerosol-generating element and a length of the hollow tubular element may be less than or equal to about 0.60.

A ratio between a length of the aerosol-generating element and a length of the hollow tubular element may be at least about 0.25. Preferably, a ratio between a length of the aerosol-generating element and a length of the hollow tubular element may be at least about 0.30. More preferably, a ratio between a length of the aerosol-generating element and a length of the hollow tubular element may be at least about 0.40. Even more preferably, a ratio between a length of the aerosol-generating element and a length of the hollow tubular element may be at least about 0.50.

In some embodiments, a ratio between a length of the aerosol-generating element and a length of the hollow tubular element is from about 0.25 to about 1.25, preferably from about 0.30 to about 1.25, more preferably from about 0.40 to about 1.25, even more preferably from about 0.50 to about 1.25. In other embodiments, a ratio between a length of the aerosol-generating element and a length of the hollow tubular element is from about 0.25 to about 1, preferably from about 0.30 to about 1, more preferably from about 0.40 to about 1, even more preferably from about 0.50 to about 1. In further embodiments, a ratio between a length of the aerosol-generating element and a length of the hollow tubular element is from about 0.25 to about 0.75, preferably from about 0.30 to about 0.75, more preferably from about 0.40 to about 0.75, even more preferably from about 0.50 to about 0.75. By way of example, a ratio between a length of the aerosol-generating element and a length of the hollow tubular element may be about 0.6, more preferably about 0.57.

A ratio between a length of the hollow tubular element and a length of the downstream section may be less than or equal to about 1. Preferably, a ratio between a length of the hollow tubular element and a length of the downstream section may be less than or equal to about 0.90. More preferably, a ratio between a length of the hollow tubular element and a length of the downstream section may be less than or equal to about 0.85. Even more preferably, a ratio between a length of the hollow tubular element and a length of the downstream section may be less than or equal to about 0.80.

A ratio between a length of the hollow tubular element and a length of the downstream section may be at least about 0.35. Preferably, a ratio between a length of the hollow tubular element and a length of the downstream section may be at least about 0.45. More preferably, a ratio between a length of the hollow tubular element and a length of the downstream section may be at least about 0.50. Even more preferably, a ratio between a length of the hollow tubular element and a length of the downstream section may be at least about 0.60.

In some embodiments, a ratio between a length of the hollow tubular element and a length of the downstream section is from about 0.35 to about 1, preferably from about 0.45 to about 1, more preferably from about 0.50 to about 1, even more preferably from about 0.60 to about 1. In other embodiments, a ratio between a length of the hollow tubular element and a length of the downstream section is from about 0.35 to about 0.90, preferably from about 0.45 to about 0.90, more preferably from about 0.50 to about 0.90, even more preferably from about 0.60 to about 0.90. In further embodiments, a ratio between a length of the hollow tubular element and a length of the downstream section is from about 0.35 to about 0.85, preferably from about 0.45 to about 0.85, more preferably from about 0.50 to about 0.85, even more preferably from about 0.60 to about 0.85. By way of example, a ratio between a length of the hollow tubular element and a length of the downstream section may preferably be about 0.75.

A ratio between a length of the hollow tubular element and an overall length of the aerosol-generating article may be less than or equal to about 0.80. Preferably, a ratio between a length of the hollow tubular element and an overall length of the aerosol-generating article may be less than or equal to about 0.70. More preferably, a ratio between a length of the hollow tubular element and an overall length of the aerosol-generating article may be less than or equal to about 0.60. Even more preferably, a ratio between a length of the hollow tubular element and an overall length of the aerosol-generating article may be less than or equal to about 0.50.

A ratio between a length of the hollow tubular element and an overall length of the aerosol-generating article may be at least about 0.25. Preferably, a ratio between a length of the hollow tubular element and an overall length of the aerosol-generating article may be at least about 0.30. More preferably, a ratio between a length of the hollow tubular element and an overall length of the aerosol-generating article may be at least about 0.40. Even more preferably, a ratio between a length of the hollow tubular element and an overall length of the aerosol-generating article may be at least about 0.45.

In some embodiments, a ratio between a length of the hollow tubular element and an overall length of the aerosol-generating article is from about 0.25 to about 0.80, preferably from about 0.30 to about 0.80, more preferably from about 0.40 to about 0.80, even more preferably from about 0.45 to about 0.80. In other embodiments, a ratio between a length of the hollow tubular element and an overall length of the aerosol-generating article is from about 0.25 to about 0.70, preferably from about 0.30 to about 0.70, more preferably from about 0.40 to about 0.70, even more preferably from about 0.45 to about 0.70. In further embodiments, a ratio between a length of the hollow tubular element and an overall length of the aerosol-generating article is from about 0.25 to about 0.60, preferably from about 0.30 to about 0.60, more preferably from about 0.40 to about 0.60, even more preferably from about 0.45 to about 0.60. By way of example, a ratio between a length of the hollow tubular element and an overall length of the aerosol-generating article may be about 0.5, more preferably about 0.47.

Providing a downstream section or hollow tubular element with the ratios listed above maximises the aerosol cooling and formation benefits of having a relatively long hollow tubular element while providing a sufficient amount of filtration for an aerosol-generating article that is configured to be heated, not combusted. Further, providing a longer hollow tubular element may advantageously lower the effective RTD of the downstream section of the aerosol-generating article, which would primarily be defined by the RTD of a mouthpiece filtration element.

The thickness of a peripheral wall (in other words, the wall thickness) of the hollow tubular element may be at least about 100 micrometres. The wall thickness of the hollow tubular element may be at least about 150 micrometres. The wall thickness of the hollow tubular element may be at least about 200 micrometres, preferably at least about 250 micrometres and even more preferably at least about 500 micrometres (or 0.5 mm).

The wall thickness of the hollow tubular element may be less than or equal to about 2 millimetres, preferably less than or equal to about 1.5 millimetres and even more preferably less than or equal to about 1.25 mm. The wall thickness of the hollow tubular element may be less than or equal to about 1 millimeter. The wall thickness of the hollow tubular element may be less than or equal to about 500 micrometres.

The wall thickness of the hollow tubular element may between about 100 micrometres and about 2 millimetres, preferably between about 150 micrometres and about 1.5 millimetres, even more preferably between about 200 micrometres and about 1.25 millimetres.

The wall thickness of the hollow tubular element may preferably be about 250 micrometres (about 0.25 mm).

At the same time, keeping the thickness of the peripheral wall of the hollow tubular element relatively low ensures that the overall internal volume of the hollow tubular element—which is made available for the aerosol to begin the nucleation process as soon as the aerosol components leave the rod of aerosol-generating substrate—and the cross-sectional surface area of the hollow tubular element are effectively maximised, whilst at the same time ensuring that the hollow tubular element has the necessary structural strength to prevent a collapse of the aerosol-generating article as well as to provide some support to the rod of aerosol-generating substrate, and that the RTD of the hollow tubular element is minimised. Greater values of cross-sectional surface area of the cavity of the hollow tubular element are understood to be associated with a reduced speed of the aerosol stream travelling along the aerosol-generating article, which is also expected to favour aerosol nucleation. Further, it would appear that by utilising a hollow tubular element having a relatively low thickness, it is possible to substantially prevent diffusion of the ventilation air prior to its contacting and mixing with the stream of aerosol, which is also understood to further favour nucleation phenomena. In practice, by providing a more controllably localised cooling of the stream of volatilised species, it is possible to enhance the effect of cooling on the formation of new aerosol particles.

The hollow tubular element preferably has an outer diameter that is approximately equal to the outer diameter of the rod of aerosol-generating substrate and to the outer diameter of the aerosol-generating article.

The hollow tubular element may have an outer diameter of between 5 millimetres and 12 millimetres, for example of between 5 millimetres and 10 millimetres or of between 6 millimetres and 8 millimetres. In a preferred embodiment, the hollow tubular element has an external diameter of 7.2 millimetres plus or minus 10 percent.

The hollow tubular element may have an internal diameter. Preferably, the hollow tubular element may have a constant internal diameter along a length of the hollow tubular element. However, the internal diameter of the hollow tubular element may vary along the length of the hollow tubular element.

The hollow tubular element may have an internal diameter of at least about 2 millimetres. For example, the hollow tubular element may have an internal diameter of at least about 4 millimetres, at least about 5 millimetres, or at least about 7 millimetres.

The provision of a hollow tubular element having an internal diameter as set out above may advantageously provide sufficient rigidity and strength to the hollow tubular element.

The hollow tubular element may have an internal diameter of no more than about 10 millimetres. For example, the hollow tubular element may have an internal diameter of no more than about 9 millimetres, no more than about 8 millimetres, or no more than about 7.5 millimetres.

The provision of a hollow tubular element having an internal diameter as set out above may advantageously reduce the resistance to draw of the hollow tubular element.

The hollow tubular element may have an internal diameter of between about 2 millimetres and about 10 millimetres, between about 4 millimetres and about 9 millimetres, between about 5 millimetres and about 8 millimetres, or between about 6 millimetres and about 7.5 millimetres.

The hollow tubular element may have an external diameter of about 7.1 or 7.2 mm. The hollow tubular element may have an internal diameter of about 6.7 millimetres.

The ratio between an internal diameter of the hollow tubular element and the external diameter of the hollow tubular element may be at least about 0.8. For example, the ratio between an internal diameter of the hollow tubular element and the external diameter of the hollow tubular element may be at least about 0.85, at least about 0.9, or at least about 0.95.

The ratio between an internal diameter of the hollow tubular element and the external diameter of the hollow tubular element may be no more than about 0.99. For example, the ratio between an internal diameter of the hollow tubular element and the external diameter of the hollow tubular element may be no more than about 0.98.

The ratio between an internal diameter of the hollow tubular element and the external diameter of the hollow tubular element may be about 0.97.

The provision of a relatively large internal diameter may advantageously reduce the resistance to draw of the hollow tubular element and enhance cooling and nucleation of aerosol particles.

The lumen or cavity of the hollow tubular element may have any cross sectional shape. The lumen of the hollow tubular element may have a circular cross sectional shape.

The hollow tubular element may comprise a paper-based material. The hollow tubular element may comprise at least one layer of paper. The paper may be very rigid paper. The paper may be crimped paper, such as crimped heat resistant paper or crimped parchment paper.

Preferably, the hollow tubular element may comprise cardboard. The hollow tubular element may be a cardboard tube. The hollow tubular element may be formed from cardboard. Advantageously, cardboard is a cost-effective material that provides a balance between being deformable in order to provide ease of insertion of the article into an aerosol-generating device and being sufficiently stiff to provide suitable engagement of the article with the interior of the device. A cardboard tube may therefore provide suitable resistance to deformation or compression during use.

The hollow tubular element may be paper tube. The hollow tubular element may be a tube formed from spirally wound paper. The hollow tubular element may be formed from a plurality of layers of the paper. The paper may have a basis weight of at least about 50 grams per square meter, at least about 60 grams per square meter, at least about 70 grams per square meter, or at least about 90 grams per square meter.

The hollow tubular element may comprise a polymeric material. For example, the hollow tubular element may comprise a polymeric film. The polymeric film may comprise a cellulosic film. The hollow tubular element may comprise low density polyethylene (LDPE) or polyhydroxyalkanoate (PHA) fibres. The hollow tubular element may comprise cellulose acetate tow.

Where the hollow tubular element comprises cellulose acetate tow, the cellulose acetate tow may have a denier per filament of between about 2 and about 4 and a total denier of between about 25 and about 40.

In some embodiments, the aerosol-generating article according to the present invention may comprise a ventilation zone at a location along the downstream section. In more detail, in those embodiments wherein the downstream section comprises a hollow tubular element, the ventilation zone may be provided at a location along the hollow tubular element.

As such, a ventilated cavity is provided downstream of the rod of aerosol-generating substrate. This provides several potential technical benefits.

First of all, the inventors have found that one such ventilated hollow tubular element provides a particularly efficient cooling of the aerosol. Thus, a satisfactory cooling of the aerosol can be achieved even by means of a relatively short downstream section. This is especially desirable as it enables the provision of an aerosol-generating article wherein an aerosol-generating substrate (and particularly a tobacco-containing one) is heated rather than combusted that combines a satisfactory aerosol delivery with an efficient cooling of the aerosol down to temperatures that are desirable for the consumer.

Secondly, the inventors have surprisingly found that such rapid cooling of the volatile species released upon heating the aerosol-generating substrate promotes enhances nucleation of aerosol particles. This effect is felt particularly when, as will be described in more detail below, the ventilation zone is arranged at a precisely defined location along the length of the hollow tubular element relative to other components of the aerosol-generating article. In effect, the inventors have found that the favourable effect of the enhanced nucleation is capable of significantly countering potentially less desirable effects of the dilution induced by the introduction of ventilation air.

A distance between the ventilation zone and an upstream end of the aerosol-generating article may be at least 25 millimetres. As used herein, the term 'distance between the ventilation zone and another element or portion of the aerosol-generating article' refers to a distance measures in the longitudinal direction, that is, in a direction extending along, or parallel to, the cylindrical axis of the aerosol-generating article.

Preferably, a distance between the ventilation zone and an upstream end of the aerosol-generating article is at least 26 millimetres. More preferably, a distance between the ventilation zone and an upstream end of the aerosol-generating article is at least 27 millimetres.

A distance between the ventilation zone and an upstream end of the aerosol-generating article may be less than or equal to 34 millimetres. Preferably, a distance between the ventilation zone and an upstream end of the aerosol-generating article is less than or equal to 33 millimetres. More preferably, a distance between the ventilation zone and an upstream end of the aerosol-generating article is less than or equal to 31 millimetres.

In some embodiments, a distance between the ventilation zone and an upstream end of the aerosol-generating article is from 25 millimetres to 34 millimetres, preferably from 26 millimetres to 34 millimetres, more preferably from 27 millimetres to 34 millimetres. In other embodiments, a distance between the ventilation zone and an upstream end of the aerosol-generating article is from 25 millimetres to 33 millimetres, preferably from 26 millimetres to 33 millimetres, more preferably from 27 millimetres to 33 millimetres.

In further embodiments, a distance between the ventilation zone and an upstream end of the aerosol-generating article is from 25 millimetres to 31 millimetres, preferably from 26 millimetres to 31 millimetres, more preferably from 27 millimetres to 31 millimetres.

In some particularly preferred embodiments, a distance between the ventilation zone and an upstream end of the aerosol-generating article is from 28 millimetres to 30 millimetres.

Aerosol-generating articles comprising a ventilation zone at a location along the hollow tubular element at a distance from an upstream end of the aerosol-generating article falling within the ranges described above have been found to present multiple benefits.

Firstly, such articles have been observed to provide particularly satisfactory aerosol deliveries to the consumer, particularly where the aerosol-generating substrate comprises tobacco.

Without wishing to be bound by theory, the intense cooling caused by the ambient air drawn into the cavity of the hollow tubular element at the ventilation zone is understood to accelerate the condensation of droplets of aerosol former (for example, glycerin) that has been released from the aerosol-generating substrate upon heating. In turn, the volatilised nicotine and organic acids similarly released from the tobacco substrate accumulate onto the newly formed droplets of aerosol former, and subsequently combine into nicotine salts. Accordingly, the overall proportion of the aerosol particulate phase to the aerosol gas phase may be enhanced compared with existing aerosol-generating articles.

Positioning the ventilation zone at a distance from an upstream end of the aerosol-generating article as described above advantageously reduces the fly time of the volatilised nicotine before the volatilised nicotine particles reach the droplets of aerosol former. At the same time, one such positioning of the ventilation zone relative to an upstream end of the aerosol-generating article ensures there are enough time and room for the accumulation of nicotine and formation of nicotine salts to occur in a significant proportion before the flow of aerosol reaches the consumer's mouth.

The ventilation zone may typically comprise a plurality of perforations through the peripheral wall of the hollow tubular element. Preferably, the ventilation zone comprises at least one circumferential row of perforations. In some embodiments, the ventilation zone may comprise two circumferential rows of perforations. For example, the perforations may be formed online during manufacturing of the aerosol-generating article. Preferably, each circumferential row of perforations comprises from 8 to 30 perforations.

An aerosol-generating article in accordance with the present invention may have a ventilation level of at least about 2 percent.

The term "ventilation level" is used throughout the present specification to denote a volume ratio between of the airflow admitted into the aerosol-generating article via the ventilation zone (ventilation airflow) and the sum of the aerosol airflow and the ventilation airflow. The greater the ventilation level, the higher the dilution of the aerosol flow delivered to the consumer. The aerosol-generating article preferably has a ventilation level of at least 5 percent, more preferably at least 10 percent, even more preferably at least 12 percent or at least 15 percent.

An aerosol-generating article in accordance with the present invention may have a ventilation level of up to about 90 percent. Preferably, an aerosol-generating article in accordance with the present invention has a ventilation level of less than or equal to 80 percent, more preferably less than or equal to 70 percent, even more preferably less than or equal to 60 percent, most preferably less than or equal to 50 percent.

Thus, an aerosol-generating article in accordance with the present invention may have a ventilation level from 2 percent to 90 percent, preferably from 5 percent to 90 percent, more preferably from 10 percent to 90 percent, even more preferably from 15 percent to 90 percent. An aerosol-generating article in accordance with the present invention may have a ventilation level from 2 percent to 80 percent, preferably from 5 percent to 80 percent, more preferably from 10 percent to 80 percent, even more preferably from 15 percent to 80 percent. An aerosol-generating article in accordance with the present invention may have a ventilation level from 2 percent to 70 percent, preferably from 5 percent to 70 percent, more preferably from 10 percent to 70 percent, even more preferably from 15 percent to 70 percent. An aerosol-generating article in accordance with the present invention may have a ventilation level from 2 percent to 60 percent, preferably from 5 percent to 60 percent, more preferably from 10 percent to 60 percent, even more preferably from 15 percent to 60 percent. An aerosol-generating article in accordance with the present invention may have a ventilation level from 2 percent to 50 percent, preferably from 5 percent to 50 percent, more preferably from 10 percent to 50 percent, even more preferably from 15 percent to 50 percent. The aerosol-generating article preferably has a ventilation level of less than or equal to 30 percent, preferably less than or equal to 25 percent, more preferably less than or equal to 20 percent, even more preferably less than or equal to 18 percent.

In some embodiments, the aerosol-generating article has a ventilation level from 10 percent to 30 percent, preferably from 12 percent to 30 percent, more preferably from 15 percent to 30 percent. In other embodiments, the aerosol-generating article has a ventilation level from 10 percent to 25 percent, preferably from 12 percent to 25 percent, more preferably from 15 percent to 25 percent. In further embodiments, the aerosol-generating article has a ventilation level from 10 percent to 20 percent, preferably from 12 percent to 20 percent, more preferably from 15 percent to 20 percent. In particularly preferred embodiments, the aerosol-generating article has a ventilation level from 10 percent to 18 percent, preferably from 12 percent to 18 percent, more preferably from 15 percent to 18 percent.

Without wishing to be bound by theory, the inventors have found that the temperature drop caused by the admission of cooler, external air into the hollow tubular element via the ventilation zone may have an advantageous effect on the nucleation and growth of aerosol particles.

Formation of an aerosol from a gaseous mixture containing various chemical species depends on a delicate interplay between nucleation, evaporation, and condensation, as well as coalescence, all the while accounting for variations in vapour concentration, temperature, and velocity fields. The so-called classical nucleation theory is based on the assumption that a fraction of the molecules in the gas phase are large enough to stay coherent for long times with sufficient probability (for example, a probability of one half). These molecules represent some kind of a critical, threshold molecule clusters among transient molecular aggregates, meaning that, on average, smaller molecule clusters are likely to disintegrate rather quickly into the gas phase, while larger clusters are, on average, likely to grow. Such critical cluster is identified as the key nucleation core from which droplets are expected to grow due to condensation of molecules from the vapour. It is assumed that virgin droplets that just nucleated emerge with a certain original diameter, and then may grow by several orders of magnitude. This is facilitated and may be enhanced by rapid cooling of the surrounding vapour, which induces condensation. In this connection, it helps to bear in mind that evaporation and condensation are two sides of one same mechanism, namely gas-liquid mass transfer. While evaporation relates to net mass transfer from the liquid droplets to the gas phase, condensation is net mass transfer from the gas phase to the droplet phase. Evaporation (or condensation) will make the droplets shrink (or grow), but it will not change the number of droplets.

In this scenario, which may be further complicated by coalescence phenomena, the temperature and rate of cooling can play a critical role in determining how the system responds. In general, different cooling rates may lead to significantly different temporal behaviours as concerns the formation of the liquid phase (droplets), because the nucleation process is typically nonlinear. Without wishing to be bound by theory, it is hypothesised that cooling can cause a rapid increase in the number concentration of droplets, which is followed by a strong, short-lived increase in this growth (nucleation burst). This nucleation burst would appear to be more significant at lower temperatures. Further, it would appear that higher cooling rates may favour an earlier onset of nucleation. By contrast, a reduction of the cooling rate would appear to have a favourable effect on the final size that the aerosol droplets ultimately reach.

Therefore, the rapid cooling induced by the admission of external air into the hollow tubular element via the ventilation zone can be favourably used to favour nucleation and growth of aerosol droplets. However, at the same time, the admission of external air into the hollow tubular element has the immediate drawback of diluting the aerosol stream delivered to the consumer.

The inventors have surprisingly found how the favourable effect of enhanced nucleation promoted by the rapid cooling induced by the introduction of ventilation air into the article is capable of significantly countering the less desirable effects of dilution. As such, satisfactory values of aerosol delivery are consistently achieved with aerosol-generating articles in accordance with the invention.

The inventors have also surprisingly found that the diluting effect on the aerosol—which can be assessed by measuring, in particular, the effect on the delivery of aerosol former (for example, glycerol) included in the aerosol-generating substrate—is advantageously minimised when the ventilation level is within the ranges described above.

In particular, ventilation levels between 10 percent and 20 percent, and even more preferably between 12 and 18 percent, have been found to lead to particularly satisfactory values of glycerol delivery.

This is particularly advantageous with "short" aerosol-generating articles, such as ones wherein a length of the rod of aerosol-generating substrate is less than about 40 millimetres, preferably less than 30 millimetres, even more preferably less than 25 millimetres, and particularly preferably less than 20 millimetres, or wherein an overall length of the aerosol-generating article is less than about 70 millimetres, preferably less than about 60 millimetres, even more preferably less than 50 millimetres. As will be appreciated, in such aerosol-generating articles, there is typically little time and space for the aerosol to form and for the particulate phase of the aerosol to become available for delivery to the consumer, and so the benefits of the enhanced nucleation described above are felt in particularly significant fashion.

Further, because the ventilated hollow tubular element substantially does not contribute to the overall RTD of the aerosol-generating article, in aerosol-generating articles in accordance with the invention the overall RTD of the article can advantageously be fine-tuned by adjusting the length and density of the rod of aerosol-generating substrate or the length and optionally the length and density of any segment of filtration material forming part of the downstream section, such as for example a mouthpiece element, or the length and density of a segment of filtration material provided upstream of the aerosol-generating substrate and the susceptor element. Thus, aerosol-generating articles that have a predetermined RTD can be manufactured consistently and with great precision, such that satisfactory levels of RTD can be provided for the consumer even in the presence of ventilation.

A distance between the ventilation zone and a downstream end of the rod of aerosol-generating substrate may be at least 4 mm or 6 mm or 8 millimetres. Preferably, a distance between the ventilation zone and a downstream end of the rod of aerosol-generating substrate is at least 9 millimetres. More preferably, a distance between the ventilation zone and a downstream end of the rod of aerosol-generating substrate is at least 10 millimetres.

A distance between the ventilation zone and a downstream end of the rod of aerosol-generating substrate is preferably less than 17 millimetres. More preferably, a distance between the ventilation zone and a downstream end of the rod of aerosol-generating substrate is less than 16 millimetres. Even more preferably, a distance between the ventilation zone and a downstream end of the rod of aerosol-generating substrate is less than 16 millimetres. In particularly preferred embodiments, a distance between the ventilation zone and a downstream end of the rod of aerosol-generating substrate is less than 15 millimetres.

In some embodiments, a distance between the ventilation zone and a downstream end of the rod of aerosol-generating substrate is from 4 millimetres to 17 millimetres, preferably from 7 millimetres to 17 millimetres, more preferably from 10 millimetres to 17 millimetres. In other embodiments, a distance between the ventilation zone and a downstream end of the rod of aerosol-generating substrate is from 8 millimetres to 16 millimetres, preferably from 9 millimetres to 16 millimetres, more preferably from 10 millimetres to 16 millimetres. In further embodiments, a distance between the ventilation zone and a downstream end of the rod of aerosol-generating substrate is from 8 millimetres to 15 millimetres, preferably from 9 millimetres to 15 millimetres, more preferably from 10 millimetres to 15 millimetres. By way of example, a distance between the ventilation zone and a downstream end of the rod of aerosol-generating substrate may be from 10 millimetres to 14 millimetres, preferably from 10 millimetres to 13 millimetres, more preferably from 10 millimetres to 12 millimetres. Positioning the ventilation zone at a distance from a downstream end of the rod of aerosol-generating substrate within the ranges described above has the benefit of generally ensuring that, during use, the ventilation zone is just outside of the heating device when the aerosol-generating article is inserted in the heating device. Additionally, it has been found that positioning the ventilation zone at a distance from a downstream end of the rod of aerosol-generating substrate within the ranges described above may advantageously enhance nucleation and aerosol formation and delivery.

A distance between the ventilation zone and a downstream end of the hollow tubular element may be at least 3 millimetres. Preferably, a distance between the ventilation zone and a downstream end of the hollow tubular element is at least 5 millimetres. More preferably, a distance between the ventilation zone and a downstream end of the hollow tubular element is at least 7 millimetres.

A distance between the ventilation zone and a downstream end of the hollow tubular element is preferably less than or equal to 14 millimetres. More preferably, a distance between the ventilation zone and a downstream end of the hollow tubular element is less than or equal to 12 millimetres. Even more preferably, a distance between the ventilation zone and a downstream end of the hollow tubular element is less than or equal to 10 millimetres. In some embodiments, a distance between the ventilation zone and a downstream end of the hollow tubular element is from 3 millimetres to 14 millimetres, preferably from 5 millimetres to 14 millimetres, more preferably from 7 millimetres to 14 millimetres. In further embodiments, a distance between the ventilation zone and a downstream end of the hollow tubular element is from 3 millimetres to 12 millimetres, preferably from 5 millimetres to 12 millimetres, more preferably from 7 millimetres to 12 millimetres. In other embodiments, a distance between the ventilation zone and a downstream end of the hollow tubular element is from 3 millimetres to 10 millimetres, preferably from 5 millimetres to 10 millimetres, more preferably from 7 millimetres to 10 millimetres.

Positioning the ventilation zone at a distance from a downstream end of the hollow tubular element within the ranges described above has the benefit of generally ensuring that, during use, the ventilation zone is just outside of the heating device when the aerosol-generating article is inserted in the heating device. Additionally, it has been found that positioning the ventilation zone at a distance from a downstream end of the hollow tubular element within the ranges described above may advantageously lead to the formation and delivery of a comparatively more homogenous aerosol.

A distance between the ventilation zone and a downstream end of the aerosol-generating article may be at least 10 millimetres. Preferably, a distance between the ventilation zone and a downstream end of the aerosol-generating article is at least 12 millimetres. More preferably, a distance between the ventilation zone and a downstream end of the aerosol-generating article is at least 15 millimetres.

A distance between the ventilation zone and a downstream end of the aerosol-generating article is preferably less than or equal to 21 millimetres. More preferably, a distance between the ventilation zone and a downstream end of the aerosol-generating article is less than or equal to 19 millimetres. Even more preferably, a distance between the ventilation zone and a downstream end of the aerosol-generating article is less than or equal to 17 millimetres.

In some embodiments, a distance between the ventilation zone and a downstream end of the aerosol-generating article is from 10 millimetres to 21 millimetres, preferably from 12 millimetres to 21 millimetres, more preferably from 15 millimetres to 21 millimetres. In further embodiments, a distance between the ventilation zone and a downstream end of the aerosol-generating article is from 10 millimetres to 19 millimetres, preferably from 12 millimetres to 19 millimetres, more preferably from 15 millimetres to 19 millimetres. In other embodiments, a distance between the ventilation zone and a downstream end of the aerosol-generating article is from 10 millimetres to 17 millimetres, preferably from 12 millimetres to 17 millimetres, more preferably from 15 millimetres to 17 millimetres.

Positioning the ventilation zone at a distance from a downstream end of the aerosol-generating article within the ranges described above has the benefit of generally ensuring that, during use, when the aerosol-generating article is partially received within the heating device, a portion of the aerosol-generating article extending outside of the heating device is long enough for the consumer to comfortably hold the article between their lips. At the same time, evidence suggests that a length of the portion of the aerosol-generating article extending outside of the heating device were greater, it may become easy to inadvertently and undesirably bend the aerosol-generating article, and this may impair aerosol delivery or in general the intended use of the aerosol-generating article.

As discussed in the present disclosure, the downstream section may comprise a mouthpiece element. The mouthpiece element may extend from a downstream end of the downstream section. The mouthpiece element may be located at the downstream end of the aerosol-generating article. The downstream end of the mouthpiece element may define the downstream end of the aerosol-generating article.

The mouthpiece element may be provided downstream of the rod of aerosol-generating substrate. The mouthpiece element may extend all the way to a mouth end of the aerosol-generating article. The mouthpiece element may comprise at least one mouthpiece filter segment formed of a fibrous filtration material. The mouthpiece element may be located downstream of a hollow tubular element, which is described above. The mouthpiece element may extend between the hollow tubular element and the downstream end of the aerosol-generating article. The mouthpiece element may be provided immediately downstream of the hollow tubular element. In other words, the mouthpiece element may abut a downstream end of the hollow tubular element. The mouthpiece element may define a downstream end of the downstream section of the aerosol-generating article.

Parameters or characteristics described in relation to the mouthpiece element as a whole may equally be applied to a mouthpiece filter segment of the mouthpiece element.

The fibrous filtration material may be for filtering the aerosol that is generated from the aerosol-generating substrate. Suitable fibrous filtration materials would be known to the skilled person. Particularly preferably, the at least one mouthpiece filter segment comprises a cellulose acetate filter segment formed of cellulose acetate tow.

In certain preferred embodiments, the mouthpiece element consists of a single mouthpiece filter segment. In alternative embodiments, the mouthpiece element includes two or more mouthpiece filter segments axially aligned in an abutting end to end relationship with each other.

In certain embodiments of the invention, the downstream section may comprise a mouth end cavity at the downstream end, downstream of the mouthpiece element as described above. The mouth end cavity may be defined by a further hollow tubular element provided at the downstream end of the mouthpiece. Alternatively, the mouth end cavity may be defined by an outer wrapper of the aerosol-generating article, wherein the outer wrapper extends in a downstream direction from (or past) the mouthpiece element.

The mouthpiece element may optionally comprise a flavourant, which may be provided in any suitable form. For example, the mouthpiece element may comprise one or more capsules, beads or granules of a flavourant, or one or more flavour loaded threads or filaments.

Preferably, the mouthpiece element, or mouthpiece filter segment thereof, has a low particulate filtration efficiency.

Preferably, the mouthpiece element is circumscribed by a plug wrap. Preferably, the mouthpiece element is unventilated such that air does not enter the aerosol-generating article along the mouthpiece element.

The mouthpiece element is preferably connected to one or more of the adjacent upstream components of the aerosol-generating article by means of a tipping wrapper.

The mouthpiece element preferably has an external diameter that is approximately equal to the external diameter of the aerosol-generating article. The diameter of a mouthpiece element (or mouthpiece filter segment) may be substantially the same as the outer diameter of the hollow tubular element. As mentioned in the present disclosure, the outer diameter of the hollow tubular element may be about 7.2 mm, plus or minus 10 percent.

The diameter of the mouthpiece element may be between about 5 mm and about 10 mm. The diameter of the mouthpiece element may be between about 6 mm and about 8 mm. The diameter of the mouthpiece element may be between about 7 mm and about 8 mm. The diameter of the mouthpiece element may be about 7.2 mm, plus or minus 10 percent. The diameter of the mouthpiece element may be about 7.25 mm, plus or minus 10 percent.

Unless otherwise specified, the resistance to draw (RTD) of a component or the aerosol-generating article is measured in accordance with ISO 6565-2015. The RTD refers the pressure required to force air through the full length of a component. The terms "pressure drop" or "draw resistance" of a component or article may also refer to the "resistance to draw". Such terms generally refer to the measurements in accordance with ISO 6565-2015 are normally carried out at under test at a volumetric flow rate of about 17.5 millilitres per second at the output or downstream end of the measured component at a temperature of about 22 degrees Celsius, a pressure of about 101 kPa (about 760 Torr) and a relative humidity of about 60%.

The resistance to draw (RTD) of the downstream section may be at least about 0 mm $H_2O$. The RTD of the downstream section may be at least about 3 mm $H_2O$. The RTD of the downstream section may be at least about 6 mm $H_2O$.

The RTD of the downstream section may be no greater than about 12 mm $H_2O$. The RTD of the downstream section may be no greater than about 11 mm $H_2O$. The RTD of the downstream section may be no greater than about 10 mm $H_2O$.

The resistance to draw of the downstream section may be greater than or equal to about 0 mm $H_2O$ and less than about 12 mm $H_2O$. Preferably, the resistance to draw of the downstream section may be greater than or equal to about 3 mm $H_2O$ and less than about 12 mm $H_2O$. The resistance to draw of the downstream section may be greater than or equal to about 0 mm $H_2O$ and less than about 11 mm $H_2O$. Even more preferably, the resistance to draw of the downstream section may be greater than or equal to about 3 mm $H_2O$ and less than about 11 mm $H_2O$. Even more preferably, the resistance to draw of the downstream section may be greater than or equal to about 6 mm $H_2O$ and less than about 10 mm $H_2O$. Preferably, the resistance to draw of the downstream section may be about 8 mm $H_2O$.

The resistance to draw (RTD) characteristics of the downstream section may be wholly or mostly attributed to the RTD characteristics of the mouthpiece element of the downstream section. In other words, the RTD of the mouthpiece element of the downstream section may wholly define the RTD of the downstream section.

The resistance to draw (RTD) of the mouthpiece element may be at least about 0 mm $H_2O$. The RTD of the mouthpiece element may be at least about 3 mm $H_2O$. The RTD of the mouthpiece element may be at least about 6 mm $H_2O$.

The RTD of the mouthpiece element may be no greater than about 12 mm $H_2O$. The RTD of the mouthpiece element may be no greater than about 11 mm $H_2O$. The RTD of the mouthpiece element may be no greater than about 10 mm $H_2O$.

The resistance to draw of the mouthpiece element may be greater than or equal to about 0 mm $H_2O$ and less than about 12 mm $H_2O$. Preferably, the resistance to draw of the mouthpiece element may be greater than or equal to about 3 mm $H_2O$ and less than about 12 mm $H_2O$. The resistance to draw of the mouthpiece element may be greater than or equal to about 0 mm $H_2O$ and less than about 11 mm $H_2O$. Even more preferably, the resistance to draw of the mouthpiece element may be greater than or equal to about 3 mm $H_2O$ and less than about 11 mm $H_2O$. Even more preferably, the resistance to draw of the mouthpiece element may be greater than or equal to about 6 mm $H_2O$ and less than about 10 mm $H_2O$. Preferably, the resistance to draw of the mouthpiece element may be about 8 mm $H_2O$.

As mentioned above, the mouthpiece element, or mouthpiece filter segment, may be formed of a fibrous material. The mouthpiece element may be formed of a porous material. The mouthpiece element may be formed of a biodegradable material. The mouthpiece element may be formed of a cellulose material, such as cellulose acetate. For example, a mouthpiece element may be formed from a bundle of cellulose acetate fibres having a denier per filament between about 10 and about 15. For example, a mouthpiece element formed from relatively low density cellulose acetate tow, such as cellulose acetate tow comprising fibres of about 12 denier per filament.

The mouthpiece element may be formed of a polylactic acid based material. The mouthpiece element may be formed of a bioplastic material, preferably a starch-based bioplastic material. The mouthpiece element may be made by injection moulding or by extrusion. Bioplastic-based materials are advantageous because they are able to provide mouthpiece element structures which are simple and cheap to manufacture with a particular and complex cross-sectional profile, which may comprise a plurality of relatively large air flow channels extending through the mouthpiece element material, that provides suitable RTD characteristics.

The mouthpiece element may be formed from a sheet of suitable material that has been crimped, pleated, gathered, woven or folded into an element that defines a plurality of longitudinally extending channels. Such sheet of suitable material may be formed of paper, cardboard, a polymer, such as polylactic acid, or any other cellulose-based, paper-based material or bioplastic-based material. A cross-sectional profile of such a mouthpiece element may show the channels as being randomly oriented.

The mouthpiece element may be formed in any other suitable manner. For example, the mouthpiece element may be formed from a bundle of longitudinally extending tubes. The longitudinally extending tubes may be formed from polylactic acid. The mouthpiece element may be formed by extrusion, moulding, lamination, injection, or shredding of a suitable material. Thus, it is preferred that there is a low-pressure drop (or RTD) from an upstream end of the mouthpiece element to a downstream end of the mouthpiece element.

The length of the mouthpiece element may be at least about 3 mm. The length of the mouthpiece element may be at least about 5 mm. The length of the mouthpiece element may equal to or less than about 11 mm. The length of the mouthpiece element may be equal to or less than about 9 mm. The length of the mouthpiece element may be between about 3 mm and about 11 mm. The length of the mouthpiece element may be between about 5 millimetres and about 9 millimetres. Preferably, the length of the mouthpiece element may be about 7 mm.

A ratio between a length of the mouthpiece element and a length of the downstream section may be less than or equal to about 0.55. Preferably, a ratio between a length of the mouthpiece element and a length of the downstream section may be less than or equal to about 0.45. More preferably, a ratio between a length of the mouthpiece element and a length of the downstream section may be less than or equal to about 0.35. Even more preferably, a ratio between a length of the mouthpiece element and a length of the downstream section may be less than or equal to about 0.25.

A ratio between a length of the mouthpiece element and a length of the downstream section may be at least about 0.05. Preferably, a ratio between a length of the mouthpiece element and a length of the downstream section may be at least about 0.10. More preferably, a ratio between a length of the mouthpiece element and a length of the downstream section may be at least about 0.15. Even more preferably, a ratio between a length of the mouthpiece element and a length of the downstream section may be at least about 0.20.

In some embodiments, a ratio between a length of the mouthpiece element and a length of the downstream section is from about 0.05 to about 0.55, preferably from about 0.10 to about 0.55, more preferably from about 0.15 to about 0.55, even more preferably from about 0.20 to about 0.55. In other embodiments, a ratio between a length of the mouthpiece element and a length of the downstream section is from about 0.05 to about 0.45, preferably from about 0.10 to about 0.45, more preferably from about 0.15 to about 0.45, even more preferably from about 0.20 to about 0.45. In further embodiments, a ratio between a length of the mouthpiece element and a length of the downstream section is from about 0.05 to about 0.35, preferably from about 0.10 to about 0.35, more preferably from about 0.15 to about 0.35, even more preferably from about 0.20 to about 0.35. By way of example, a ratio between a length of the mouthpiece element and a length of the downstream section may preferably between about 0.20 and about 0.25, more preferably a ratio between a length of the mouthpiece element and a length of the downstream section may be about 0.25.

A ratio between a length of the mouthpiece element and an overall length of the aerosol-generating article may be less than or equal to about 0.40. Preferably, a ratio between a length of the mouthpiece element and an overall length of the aerosol-generating article may be less than or equal to about 0.30. More preferably, a ratio between a length of the mouthpiece element and an overall length of the aerosol-generating article may be less than or equal to about 0.25. Even more preferably, a ratio between a length of the mouthpiece element and an overall length of the aerosol-generating article may be less than or equal to about 0.20.

A ratio between a length of the mouthpiece element and an overall length of the aerosol-generating article may be at least about 0.05. Preferably, a ratio between a length of the mouthpiece element and an overall length of the aerosol-generating article may be at least about 0.07. More preferably, a ratio between a length of the mouthpiece element and an overall length of the aerosol-generating article may be at least about 0.10. Even more preferably, a ratio between a length of the mouthpiece element and an overall length of the aerosol-generating article may be at least about 0.15.

In some embodiments, a ratio between a length of the mouthpiece element and an overall length of the aerosol-generating article is from about 0.05 to about 0.40, preferably from about 0.07 to about 0.40, more preferably from about 0.10 to about 0.40, even more preferably from about 0.15 to about 0.40. In other embodiments, a ratio between a length of the mouthpiece element and an overall length of the aerosol-generating article is from about 0.05 to about 0.30, preferably from about 0.07 to about 0.30, more preferably from about 0.10 to about 0.30, even more preferably from about 0.15 to about 0.30. In further embodiments, a ratio between a length of the mouthpiece element and an overall length of the aerosol-generating article is from about 0.05 to about 0.25, preferably from about 0.07 to about 0.25, more preferably from about 0.10 to about 0.25, even more preferably from about 0.15 to about 0.25. By way of example, a ratio between a length of the mouthpiece element and an overall length of the aerosol-generating article may be between about 0.15 and about 0.20, more preferably ratio between a length of the mouthpiece element and an overall length of the aerosol-generating article may be about 0.16.

In embodiments where the downstream section comprises a hollow tubular element and a mouthpiece element, a ratio of the length of the hollow tubular element to the length of the mouthpiece element may be at least about 1.25. In other words, the length of the hollow tubular element may be equivalent to about 125% of the length of the mouthpiece. A ratio of the length of the hollow tubular element to the length of the mouthpiece element may be at least about 1.5. A ratio of the length of the hollow tubular element to the length of the mouthpiece element may be at least about 2.

A ratio of the length of the hollow tubular element to the length of the mouthpiece element may be equal to or less than about 8.5. A ratio of the length of the hollow tubular element to the length of the mouthpiece element may be equal to or less than about 6. A ratio of the length of the hollow tubular element to the length of the mouthpiece element may be equal to or less than about 4.

A ratio of the length of the hollow tubular element to the length of the mouthpiece element may be between about 1.25 and about 8.5. A ratio of the length of the hollow tubular element to the length of the mouthpiece element may be between about 1.5 and about 6. A ratio of the length of the hollow tubular element to the length of the mouthpiece element may be between about 2 and about 4.

Preferably, a ratio of the length of the hollow tubular element to the length of the mouthpiece element may be about 3. In such an embodiment, the length of the hollow tubular element is about 21 mm and the length of the mouthpiece element is about 7 mm.

The aerosol-generating article may have an overall length from about 35 millimetres to about 100 millimetres.

Preferably, an overall length of an aerosol-generating article in accordance with the invention is at least about 38 millimetres. More preferably, an overall length of an aerosol-generating article in accordance with the invention is at least about 40 millimetres. Even more preferably, an overall length of an aerosol-generating article in accordance with the invention is at least about 42 millimetres.

An overall length of an aerosol-generating article in accordance with the invention is preferably less than or equal to 70 millimetres. More preferably, an overall length of an aerosol-generating article in accordance with the invention is preferably less than or equal to 60 millimetres. Even more preferably, an overall length of an aerosol-generating article in accordance with the invention is preferably less than or equal to 50 millimetres.

In some embodiments, an overall length of the aerosol-generating article is preferably from about 38 millimetres to about 70 millimetres, more preferably from about 40 millimetres to about 70 millimetres, even more preferably from about 42 millimetres to about 70 millimetres. In other embodiments, an overall length of the aerosol-generating article is preferably from about 38 millimetres to about 60 millimetres, more preferably from about 40 millimetres to about 60 millimetres, even more preferably from about 42 millimetres to about 60 millimetres. In further embodiments, an overall length of the aerosol-generating article is preferably from about 38 millimetres to about 50 millimetres, more preferably from about 40 millimetres to about 50 millimetres, even more preferably from about 42 millimetres to about 50 millimetres. In an exemplary embodiment, an overall length of the aerosol-generating article is about 45 millimetres.

The aerosol-generating article has an external diameter of at least 5 millimetres. Preferably, the aerosol-generating article has an external diameter of at least 6 millimetres. More preferably, the aerosol-generating article has an external diameter of at least 7 millimetres.

Preferably, the aerosol-generating article has an external diameter of less than or equal to about 12 millimetres. More preferably, the aerosol-generating article has an external diameter of less than or equal to about 10 millimetres. Even more preferably, the aerosol-generating article has an external diameter of less than or equal to about 8 millimetres.

In some embodiments, the aerosol-generating article has an external diameter from about 5 millimetres to about 12 millimetres, preferably from about 6 millimetres to about 12 millimetres, more preferably from about 7 millimetres to about 12 millimetres. In other embodiments, the aerosol-generating article has an external diameter from about 5 millimetres to about 10 millimetres, preferably from about 6 millimetres to about 10 millimetres, more preferably from about 7 millimetres to about 10 millimetres. In further embodiments, the aerosol-generating article has an external diameter from about 5 millimetres to about 8 millimetres, preferably from about 6 millimetres to about 8 millimetres, more preferably from about 7 millimetres to about 8 millimetres.

The external diameter of the aerosol-generating article may be substantially constant over the whole length of the article. As an alternative, different portions of the aerosol-generating article may have different external diameters.

In particularly preferred embodiments, one or more of the components of the aerosol-generating article are individually circumscribed by their own wrapper.

In an embodiment, the rod of aerosol-generating substrate and the mouthpiece element are individually wrapped. The upstream element, the rod of aerosol-generating substrate and the hollow tubular element are then combined together with an outer wrapper. Subsequently, they are combined with the mouthpiece element—which has its own wrapper—by means of tipping paper.

Preferably, at least one of the components of the aerosol-generating article is wrapped in a hydrophobic wrapper.

The term "hydrophobic" refers to a surface exhibiting water repelling properties. One useful way to determine this is to measure the water contact angle. The "water contact angle" is the angle, conventionally measured through the liquid, where a liquid/vapour interface meets a solid surface. It quantifies the wettability of a solid surface by a liquid via the Young equation. Hydrophobicity or water contact angle may be determined by utilizing TAPPI T558 test method and the result is presented as an interfacial contact angle and reported in "degrees" and can range from near zero to near 180 degrees.

In preferred embodiments, the hydrophobic wrapper is one including a paper layer having a water contact angle of about 30 degrees or greater, and preferably about 35 degrees or greater, or about 40 degrees or greater, or about 45 degrees or greater.

By way of example, the paper layer may comprise PVOH (polyvinyl alcohol) or silicon. The PVOH may be applied to the paper layer as a surface coating, or the paper layer may comprise a surface treatment comprising PVOH or silicon.

In a particularly preferred embodiment, an aerosol-generating article in accordance with the present invention comprises, in linear sequential arrangement, an upstream element, a rod of aerosol-generating substrate located immediately downstream of the upstream element, a hollow tubular element located immediately downstream of the rod of aerosol-generating substrate, a mouthpiece element located immediately downstream of the aerosol-cooling element, and one or more outer wrappers combining the upstream element, the rod of aerosol-generating substrate, the hollow tubular element and the mouthpiece element. The upstream element defines an upstream section of the aerosol-generating article. The hollow tubular element and the mouthpiece element form a downstream section of the aerosol-generating article.

The rod of aerosol-generating substrate may abut the upstream element. The hollow tubular element may abut the rod of aerosol-generating substrate. The mouthpiece element may abut the hollow tubular element. Preferably, the hollow tubular element abuts the rod of aerosol-generating substrate and the mouthpiece element abuts the hollow tubular element.

The aerosol-generating article has a substantially cylindrical shape and an outer diameter of 7.23 millimetres.

The upstream element defining the upstream section has a length of 5 millimetres, the rod of aerosol-generating article has a length of 12 millimetres, the hollow tubular element has a length of 21 millimetres, and the mouthpiece element has a length of 7 millimetres. Thus, a length of the downstream section is 28 mm and an overall length of the aerosol-generating article is about 45 millimetres. Thus, a combined length of the hollow tubular element and the mouthpiece element is 28 mm.

The upstream element is in the form of a hollow plug of cellulose acetate tow wrapped in stiff plug wrap.

The rod of aerosol-generating substrate comprises at least one of the types of aerosol-generating substrate described above, and preferably a shredded tobacco material. In a preferred embodiment, the rod of aerosol-generating substrate comprises 150 milligrams of a shredded tobacco material comprising from 13 percent by weight to 18 percent by weight of glycerol.

In more detail, the hollow tubular element is in the form of a cardboard tube and has an internal diameter of about 6.7 millimetres. Thus, a thickness of a peripheral wall of the hollow tubular element is about 0.25 millimetres.

A ventilation zone comprising a circumferential row of openings is provided along the hollow tubular element at 12 millimetres from an upstream end of the hollow tubular element and at 29 millimetres from an upstream end of the upstream element (or upstream end of the aerosol-generating article).

The mouthpiece is in the form of a low-density cellulose acetate filter segment.

As discussed above, the present disclosure also relates to an aerosol-generating system comprising an aerosol-generating device having a distal end and a mouth end. The aerosol-generating device may comprise a body. The body or housing of the aerosol-generating device may define a device cavity for removably receiving the aerosol-generating article at the mouth end of the device. The aerosol-generating device may comprise a heating element or heater for heating the aerosol-generating substrate when the aerosol-generating article is received within the device cavity.

The device cavity may be referred to as the heating chamber of the aerosol-generating device. The device cavity may extend between a distal end and a mouth, or proximal, end. The distal end of the device cavity may be a closed end and the mouth, or proximal, end of the device cavity may be an open end. An aerosol-generating article may be inserted into the device cavity, or heating chamber, via the open end of the device cavity. The device cavity may be cylindrical in shape so as to conform to the same shape of an aerosol-generating article.

The expression "received within" may refer to the fact that a component or element is fully or partially received within another component or element. For example, the expression "aerosol-generating article is received within the device cavity" refers to the aerosol-generating article being fully or partially received within the device cavity of the aerosol-generating article. When the aerosol-generating article is received within the device cavity, the aerosol-generating article may abut the distal end of the device cavity. When the aerosol-generating article is received within the device cavity, the aerosol-generating article may be in substantial proximity to the distal end of the device cavity. The distal end of the device cavity may be defined by an end-wall.

The length of the device cavity may be between about 10 mm and about 50 mm. The length of the device cavity may be between about 20 mm and about 40 mm. The length of the device cavity may be between about 25 mm and about 30 mm.

The length of the device cavity (or heating chamber) may be the same as or greater than the length of the rod of the aerosol-generating substrate. The length of the device cavity may be the same as or greater than the combined length of the upstream section or element and rod of aerosol-generating substrate. The length of the device cavity may be such that the downstream section or a portion thereof is configured to protrude from the device cavity, when the aerosol-generating article received within the device cavity. The length of the device cavity may be such that a portion of the downstream section (such as the hollow tubular element or mouthpiece element) is configured to protrude from the device cavity, when the aerosol-generating article received within the device cavity. The length of the device cavity may be such that a portion of the downstream section (such as the hollow tubular element or mouthpiece element) is configured to be received within the device cavity, when the aerosol-generating article received within the device cavity.

At least 25 percent of the length of the downstream section may be inserted or received within the device cavity, when the aerosol-generating article is received within the device. At least 30 percent of the length of the downstream section may be inserted or received within the device cavity, when the aerosol-generating article is received within the device.

At least 30 percent of the length of the hollow tubular element may be inserted or received within the device cavity, when the aerosol-generating article is received within the device. At least 40 percent of the length of the hollow tubular element may be inserted or received within the device cavity, when the aerosol-generating article is received within the device. At least 50 percent of the length of the hollow tubular element may be inserted or received within the device cavity, when the aerosol-generating article is received within the device. Various lengths of the hollow tubular element are described in more detail within the present disclosure.

Optimising the amount or length of the article that is inserted into the aerosol-generating device may enhance the article's resistance to inadvertently falling out during use. Particularly, during the heating of the aerosol-generating substrate, the substrate may shrink such that its external diameter may have reduced, thereby reducing the extent to which the inserted portion of the article inserted into the device can frictionally engage with the device cavity. The inserted portion of the article, or the portion of the article configured to be received within the device cavity, may be the same length as the device cavity.

Preferably, the length of the device cavity is between about 25 mm and about 29 mm. More preferably, the length of the device cavity is between about 26 mm and about 29 mm. Even more preferably, the length of the device cavity is about 27 mm or about 28 mm.

Preferably, the combined length of the upstream section (or element) and the inserted portion of the downstream section or hollow tubular element is equivalent to between about 80 percent and about 120 percent of the length of the protruding portion of the aerosol-generating article. The inserted portion of the downstream section or hollow tubular element or aerosol-generating article refers to the portion of the downstream section or hollow tubular element or aerosol-generating article that is configured to be positioned within the device cavity when the aerosol-generating article is received therein. The protruding portion of the aerosol-generating article refers to the article that is configured to be positioned outside of the device cavity, or protrude from the device, when the aerosol-generating article is received therein. The inventors have found that such a relationship minimises the risk of inadvertent exit of the article from the device during use, particularly following potential shrinkage of the article during use. The portion of the aerosol-generating article configured to be inserted into the device is preferably longer than the portion of the aerosol-generating article configured to be protruding from the device, when the aerosol-generating article is received within the aerosol-generating device.

A diameter of the device cavity may be between about 4 mm and about 10 mm. A diameter of the device cavity may be between about 5 mm and about 9 mm. A diameter of the device cavity may be between about 6 mm and about 8 mm. A diameter of the device cavity may be between about 7 mm and about 8 mm. A diameter of the device cavity may be between about 7 mm and about 7.5 mm.

A diameter of the device cavity may be substantially the same as or greater than a diameter of the aerosol-generating article. A diameter of the device cavity may be the same as a diameter of the aerosol-generating article in order to establish a tight fit with the aerosol-generating article.

The device cavity may be configured to establish a tight fit with an aerosol-generating article received within the device cavity. Tight fit may refer to a snug fit. The aerosol-generating device may comprise a peripheral wall. Such a peripheral wall may define the device cavity, or heating chamber. The peripheral wall defining the device cavity may be configured to engage with an aerosol-generating article received within the device cavity in a tight fit manner, so that there is substantially no gap or empty space between the peripheral wall defining the device cavity and the aerosol-generating article when received within the device.

Such a tight fit may establish an airtight fit or configuration between the device cavity and an aerosol-generating article received therein.

With such an airtight configuration, there would be substantially no gap or empty space between the peripheral wall defining the device cavity and the aerosol-generating article for air to flow through.

The tight fit with an aerosol-generating article may be established along the entire length of the device cavity or along a portion of the length of the device cavity.

The aerosol-generating device may comprise an air-flow channel extending between a channel inlet and a channel outlet. The air-flow channel may be configured to establish a fluid communication between the interior of the device cavity and the exterior of the aerosol-generating device. The air-flow channel of the aerosol-generating device may be defined within the housing of the aerosol-generating device to enable fluid communication between the interior of the device cavity and the exterior of the aerosol-generating device. When an aerosol-generating article is received within the device cavity, the air-flow channel may be configured to provide air flow into the article in order to deliver generated aerosol to a user drawing from the mouth end of the article.

The air-flow channel of the aerosol-generating device may be defined within, or by, the peripheral wall of the housing of the aerosol-generating device. In other words, the air-flow channel of the aerosol-generating device may be defined within the thickness of the peripheral wall or by the inner surface of the peripheral wall, or a combination of both. The air-flow channel may partially be defined by the inner surface of the peripheral wall and may be partially defined within the thickness of the peripheral wall. The inner surface of the peripheral wall defines a peripheral boundary of the device cavity.

The air-flow channel of the aerosol-generating device may extend from an inlet located at the mouth end, or proximal end, of the aerosol-generating device to an outlet located away from mouth end of the device. The air-flow channel may extend along a direction parallel to the longitudinal axis of the aerosol-generating device.

The heater may be any suitable type of heater. Preferably, in the present invention, the heater is an external heater.

Preferably, the heater may externally heat the aerosol-generating article when received within the aerosol-generating device. Such an external heater may circumscribe the aerosol-generating article when inserted in or received within the aerosol-generating device.

In some embodiments, the heater is arranged to heat the outer surface of the aerosol-generating substrate. In some embodiments, the heater is arranged for insertion into an aerosol-generating substrate when the aerosol-generating substrate is received within the cavity. The heater may be positioned within the device cavity, or heating chamber.

The heater may comprise at least one heating element. The at least one heating element may be any suitable type of heating element. In some embodiments, the device comprises only one heating element. In some embodiments, the device comprises a plurality of heating elements. The heater may comprise at least one resistive heating element. Preferably, the heater comprises a plurality of resistive heating elements. Preferably, the resistive heating elements are electrically connected in a parallel arrangement. Advantageously, providing a plurality of resistive heating elements electrically connected in a parallel arrangement may facilitate the delivery of a desired electrical power to the heater while reducing or minimising the voltage required to provide the desired electrical power. Advantageously, reducing or minimising the voltage required to operate the heater may facilitate reducing or minimising the physical size of the power supply.

Suitable materials for forming the at least one resistive heating element include but are not limited to: semiconductors such as doped ceramics, electrically 'conductive' ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal® and iron-manganese-aluminium based alloys.

In some embodiments, the at least one resistive heating element comprises one or more stamped portions of electrically resistive material, such as stainless steel. Alternatively, the at least one resistive heating element may comprise a heating wire or filament, for example a Ni—Cr (Nickel-Chromium), platinum, tungsten or alloy wire.

In some embodiments, the at least one heating element comprises an electrically insulating substrate, wherein the at least one resistive heating element is provided on the electrically insulating substrate.

The electrically insulating substrate may comprise any suitable material. For example, the electrically insulating substrate may comprise one or more of: paper, glass, ceramic, anodized metal, coated metal, and Polyimide. The ceramic may comprise mica, Alumina ($Al_2O_3$) or Zirconia ($ZrO_2$). Preferably, the electrically insulating substrate has a thermal conductivity of less than or equal to about 40 Watts per metre Kelvin, preferably less than or equal to about 20 Watts per metre Kelvin and ideally less than or equal to about 2 Watts per metre Kelvin.

The heater may comprise a heating element comprising a rigid electrically insulating substrate with one or more electrically conductive tracks or wire disposed on its surface. The size and shape of the electrically insulating substrate may allow it to be inserted directly into an aerosol-generating substrate. If the electrically insulating substrate is not sufficiently rigid, the heating element may comprise a further reinforcement means. A current may be passed through the one or more electrically conductive tracks to heat the heating element and the aerosol-generating substrate.

In some embodiments, the heater comprises an inductive heating arrangement. The inductive heating arrangement may comprise an inductor coil and a power supply configured to provide high frequency oscillating current to the inductor coil. As used herein, a high frequency oscillating current means an oscillating current having a frequency of between about 500 kHz and about 30 MHz. The heater may advantageously comprise a DC/AC inverter for converting a DC current supplied by a DC power supply to the alternating current. The inductor coil may be arranged to generate a high frequency oscillating electromagnetic field on receiving a high frequency oscillating current from the power supply. The inductor coil may be arranged to generate a high frequency oscillating electromagnetic field in the device cavity. In some embodiments, the inductor coil may substantially circumscribe the device cavity. The inductor coil may extend at least partially along the length of the device cavity.

The heater may comprise an inductive heating element. The inductive heating element may be a susceptor element. As used herein, the term 'susceptor element' refers to an element comprising a material that is capable of converting electromagnetic energy into heat. When a susceptor element is located in an alternating electromagnetic field, the susceptor is heated. Heating of the susceptor element may be the result of at least one of hysteresis losses and eddy currents induced in the susceptor, depending on the electrical and magnetic properties of the susceptor material.

A susceptor element may be arranged such that, when the aerosol-generating article is received in the cavity of the aerosol-generating device, the oscillating electromagnetic field generated by the inductor coil induces a current in the susceptor element, causing the susceptor element to heat up. In these embodiments, the aerosol-generating device is preferably capable of generating a fluctuating electromagnetic field having a magnetic field strength (H-field strength) of between 1 and 5 kilo amperes per metre (kA m), preferably between 2 and 3 kA/m, for example about 2.5 kA/m. The electrically-operated aerosol-generating device is preferably capable of generating a fluctuating electromagnetic field having a frequency of between 1 and 30 MHz, for example between 1 and 10 MHz, for example between 5 and 7 MHz.

In these embodiments, the susceptor element is preferably located in contact with the aerosol-forming substrate. In some embodiments, a susceptor element is located in the aerosol-generating device. In these embodiments, the susceptor element may be located in the cavity. The aerosol-generating device may comprise only one susceptor element. The aerosol-generating device may comprise a plurality of susceptor elements. In some embodiments, the susceptor element is preferably arranged to heat the outer surface of the aerosol-forming substrate.

The susceptor element may comprise any suitable material. The susceptor element may be formed from any material that can be inductively heated to a temperature sufficient to release volatile compounds from the aerosol-forming substrate. Suitable materials for the elongate susceptor element include graphite, molybdenum, silicon carbide, stainless steels, niobium, aluminium, nickel, nickel containing compounds, titanium, and composites of metallic materials. Some susceptor elements comprise a metal or carbon. Advantageously the susceptor element may comprise or consist of a ferromagnetic material, for example, ferritic iron, a ferromagnetic alloy, such as ferromagnetic steel or stainless steel, ferromagnetic particles, and ferrite. A suitable susceptor element may be, or comprise, aluminium. The susceptor element preferably comprises more than about 5 percent, preferably more than about 20 percent, more preferably more than about 50 percent or more than about 90 percent of ferromagnetic or paramagnetic materials. Some elongate susceptor elements may be heated to a temperature in excess of about 250 degrees Celsius.

The susceptor element may comprise a non-metallic core with a metal layer disposed on the non-metallic core. For example, the susceptor element may comprise metallic tracks formed on an outer surface of a ceramic core or substrate.

In some embodiments the aerosol-generating device may comprise at least one resistive heating element and at least one inductive heating element. In some embodiments the aerosol-generating device may comprise a combination of resistive heating elements and inductive heating elements.

During use, the heater may be controlled to operate within a defined operating temperature range, below a maximum operating temperature. An operating temperature range between about 150 degrees Celsius and about 300 degrees Celsius in the heating chamber (or device cavity) is preferable. The operating temperature range of the heater may be between about 150 degrees Celsius and about 250 degrees Celsius.

Preferably, the operating temperature range of the heater may be between about 150 degrees Celsius and about 200 degrees Celsius. More preferably, the operating temperature range of the heater may be between about 180 degrees Celsius and about 200 degrees Celsius. In particular, it has been found that optimal and consistent aerosol delivery may be achieved when using an aerosol-generating device having an external heater, which has an operating temperature range between about 180 degrees Celsius and about 200 degrees Celsius, with aerosol-generating articles having a relatively low RTD (for example, with a downstream section RTD of less than 15 mm $H_2O$), as mentioned in the present disclosure.

In embodiments where the aerosol-generating article comprises a ventilation zone at a location along the downstream section or the hollow tubular element, the ventilation zone may be arranged to be exposed when the aerosol-generating article is received within the device cavity. Thus, the length of the device cavity or heating chamber may be less than the distance of the upstream end of the aerosol-generating article to a ventilation zone located along the downstream section. In other words, when the aerosol-generating article is received within the aerosol-generating device, the distance between the ventilation zone and the upstream end of the upstream element may be greater than the length of the heating chamber.

When the article is received within the device cavity, the ventilation zone may be located at least 0.5 mm away (in the downstream direction of the article) from the mouth end (or mouth end face) of the device cavity or device itself. When the article is received within the device cavity, the ventilation zone may be located at least 1 mm away (in the downstream direction of the article) from the mouth end (or mouth end face) of the device cavity or device itself. When the article is received within the device cavity, the ventilation zone may be located at least 2 mm away (in the downstream direction of the article) from the mouth end (or mouth end face) of the device cavity or device itself.

Preferably, a ratio between the distance between the ventilation zone and the upstream end of the upstream element and a length of the heating chamber is from about 1.03 to about 1.13.

Such positioning of the ventilation zone ensures the ventilation zone is not occluded within the device cavity itself, while also minimising the risk of occlusion by a user's lips or hands as the ventilation zone is located at the most upstream position from the downstream end of the article as reasonably possible without being occluded within the device cavity.

The aerosol-generating device may comprise a power supply. The power supply may be a DC power supply. In some embodiments, the power supply is a battery. The power supply may be a nickel-metal hydride battery, a nickel cadmium battery, or a lithium based battery, for example a lithium-cobalt, a lithium-iron-phosphate or a lithium-polymer battery. However, in some embodiments the power supply may be another form of charge storage device, such as a capacitor. The power supply may require recharging and may have a capacity that allows for the storage of enough energy for one or more user operations, for example one or more aerosol-generating experiences. For example, the power supply may have sufficient capacity to allow for continuous heating of an aerosol-generating substrate for a period of around six minutes, corresponding to the typical time taken to smoke a conventional cigarette, or for a period that is a multiple of six minutes. In another example, the power supply may have sufficient capacity to allow for a predetermined number of puffs or discrete activations of the heater.

Below, there is provided a non-exhaustive list of non-limiting examples. Any one or more of the features of these examples may be combined with any one or more features of another example, embodiment, or aspect described herein.

EX1. An aerosol-generating article comprising: a rod of aerosol-generating substrate; and a downstream section provided downstream of the rod of aerosol-generating substrate, the downstream section comprising at least one hollow tubular element.

EX2. An aerosol-generating article according to example EX1, further comprising an upstream section provided upstream of the rod of aerosol-generating substrate, the upstream section comprising at least one upstream element.

EX3. An aerosol-generating article according to example EX2, wherein the upstream element has a length of between 2 millimetres and 8 millimetres.

EX4. An aerosol-generating article according to example EX2 or EX3, wherein the upstream element is formed of a hollow tubular segment defining a longitudinal cavity providing an unrestricted flow channel.

EX5. An aerosol-generating article according to example EX4, wherein the longitudinal cavity of the hollow tubular segment has a diameter of at least 5 millimetres.

EX6. An aerosol-generating article according to example EX4 or EX5, wherein the hollow tubular segment has a wall thickness of less than 1 millimeter.

EX7. An aerosol-generating article according to any of examples EX2 to EX6, wherein the upstream element has a resistance to draw (RTD) of less than 2 mm $H_2O$.

EX8. An aerosol-generating article according to any of examples EX2 to EX7, wherein an upstream end of the upstream element defines an upstream end of the aerosol-generating article.

EX9. An aerosol-generating article according to any preceding example, further comprising a ventilation zone.

EX10. An aerosol-generating article according to example EX9, wherein the ventilation zone is provided at a location along the hollow tubular element of the downstream section.

EX11. An aerosol-generating article according to example EX9 or EX10, wherein the ventilation zone is provided at a distance of between 26 millimetres and 33 millimetres from the upstream end of the article.

EX12. An aerosol-generating article according to example EX9 or EX10, wherein the ventilation zone is provided at a distance of between 27 millimetres and 31 millimetres from the upstream end of the article.

EX13. An aerosol-generating article according to any of examples EX9 to EX12, wherein the ventilation zone is provided at a distance of between 12 millimetres and 20 millimetres from the downstream end of the article.

EX14. An aerosol-generating article according to any of examples EX9 to EX13, wherein the ventilation zone is provided at least 10 millimetres downstream of the downstream end of the rod of aerosol-generating substrate.

EX15. An aerosol-generating article according to any preceding example, wherein the hollow tubular element of the downstream section has a length of between 17 millimetres and 25 millimetres.

EX16. An aerosol-generating article according to any preceding example, wherein the hollow tubular element of the downstream section has an internal volume of at least 300 cubic millimetres.

EX17. An aerosol-generating article according to any preceding example, wherein the rod of aerosol-generating substrate has a length of between 8 millimetres and 16 millimetres.

EX18. An aerosol-generating article according to any preceding example, wherein the rod of aerosol-generating substrate has a resistance to draw (RTD) of between 4 mm$H_2O$ and 10 mm $H_2O$.

EX19. An aerosol-generating article according to any preceding example, wherein the aerosol-generating substrate comprises a shredded tobacco material.

EX20. An aerosol-generating article according to example EX19, wherein the shredded tobacco material has an average density of between 150 milligrams per cubic centimetre and 500 milligrams per cubic centimetre.

EX21. An aerosol-generating article according to any preceding example, wherein the aerosol-generating substrate comprises one or more aerosol formers and wherein the content of aerosol former in the aerosol-generating substrate is between 10 percent and 20 percent by weight, on a dry weight basis.

EX22. An aerosol-generating article according to example EX19, wherein the aerosol former comprises one or more of glycerine and propylene glycol.

EX23. An aerosol-generating article according to any preceding example, wherein the aerosol-generating substrate comprises tobacco cut filler.

EX24. An aerosol-generating article according to any preceding example, wherein the downstream section further comprises a mouthpiece element.

EX25. An aerosol-generating article according to example EX24, wherein the mouthpiece element comprises at least one mouthpiece filter segment formed of a fibrous filtration material.

EX26. An aerosol-generating article according to example EX24 or EX25, wherein the length of the mouthpiece element is between 3 millimetres and 11 millimetres EX27. An aerosol-generating article according to any of examples EX24 to EX26, wherein the mouthpiece element has a resistance to draw (RTD) of between 4 $mmH_2O$ and 11 $mmH_2O$.

EX28. An aerosol-generating article according to any of examples EX24 to EX27, wherein the combined length of the hollow tubular element and mouthpiece element of the downstream section is between 24 millimetres and 32 millimetres.

EX29. An aerosol-generating article according to any preceding example, wherein the resistance to draw (RTD) of the article is between 20 mm $H_2O$ and 22 mm $H_2O$.

EX30. An aerosol-generating article according to any preceding example, wherein the external diameter of the article is substantially uniform along its length.

EX31. An aerosol-generating article according to any preceding example, wherein a ventilation level of the aerosol-generating article is from 10 percent to 30 percent.

EX32. An aerosol-generating article according to any preceding example, wherein a EX33. An aerosol-generating system comprising an aerosol-generating article according to any one of the preceding examples and an aerosol-generating device comprising a heating chamber for receiving the aerosol-generating article and at least a heating element provided at or about the periphery of the heating chamber.

In the following, the invention will be further described with reference to the drawings of the accompanying Figures, wherein.

Figure 1:
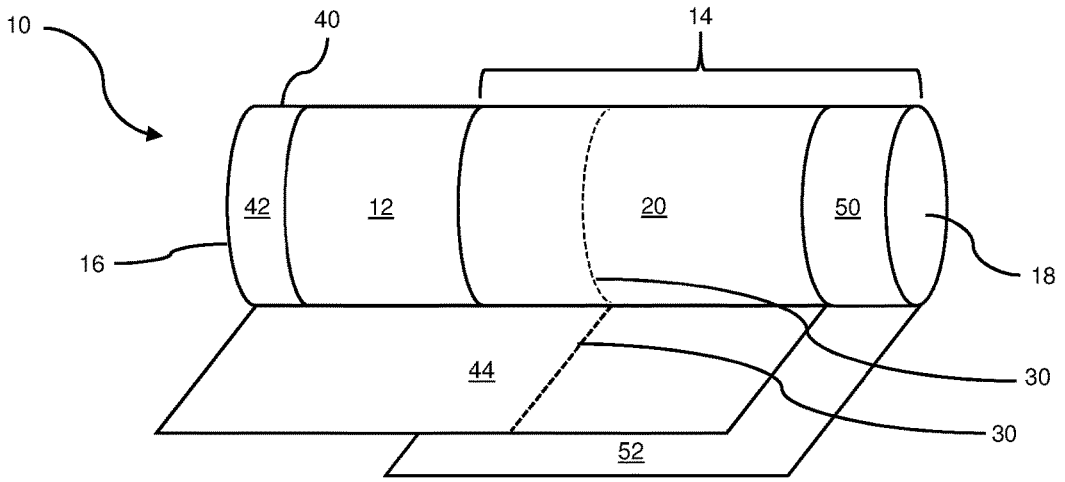
FIG. 1 shows a schematic side perspective view of an aerosol-generating article in accordance with an embodiment of the invention.

The aerosol-generating article 10 shown in FIG. 1 comprises a rod of aerosol-generating substrate 12 and a downstream section 14 at a location downstream of the rod 12 of aerosol-generating substrate. Thus, the aerosol-generating article 10 extends from an upstream or distal end 16—which substantially coincides with an upstream end of the rod 12—to a downstream or mouth end 18, which coincides with a downstream end of the downstream section 14. The downstream section 14 comprises a hollow tubular element 20 and a mouthpiece element 50.

The aerosol-generating article 10 has an overall length of about 45 millimetres and an outer diameter of about 7.2 mm.

The rod of aerosol-generating substrate 12 comprises a shredded tobacco material. The rod of aerosol-generating substrate 12 comprises 150 milligrams of a shredded tobacco material comprising from 13 percent by weight to 16 percent by weight of glycerine. The density of the aerosol-generating substrate is about 300 mg per cubic centimetre. The RTD of the rod of aerosol-generating substrate 12 is between about 6 to 8 mm $H_2O$. The rod of aerosol-generating substrate 12 is individually wrapped by a plug wrap (not shown). The plug wrap (not shown) wrapping the rod of aerosol-generating substrate comprises a non-porous paper having a grammage of about 25 grams per square metre (gsm) and a thickness of about 40 micrometres.

The hollow tubular element 20 is located immediately downstream of the rod 12 of aerosol-generating substrate, the hollow tubular element 20 being in longitudinal alignment with the rod 12. The upstream end of the hollow tubular element 20 abuts the downstream end of the rod 12 of aerosol-generating substrate.

The hollow tubular element 20 defines a hollow section of the aerosol-generating article 10. The hollow tubular element does not substantially contribute to the overall RTD of the aerosol-generating article. In more detail, an RTD of the hollow tubular element 20 is about 0 mm $H_2O$.

Figure 2:
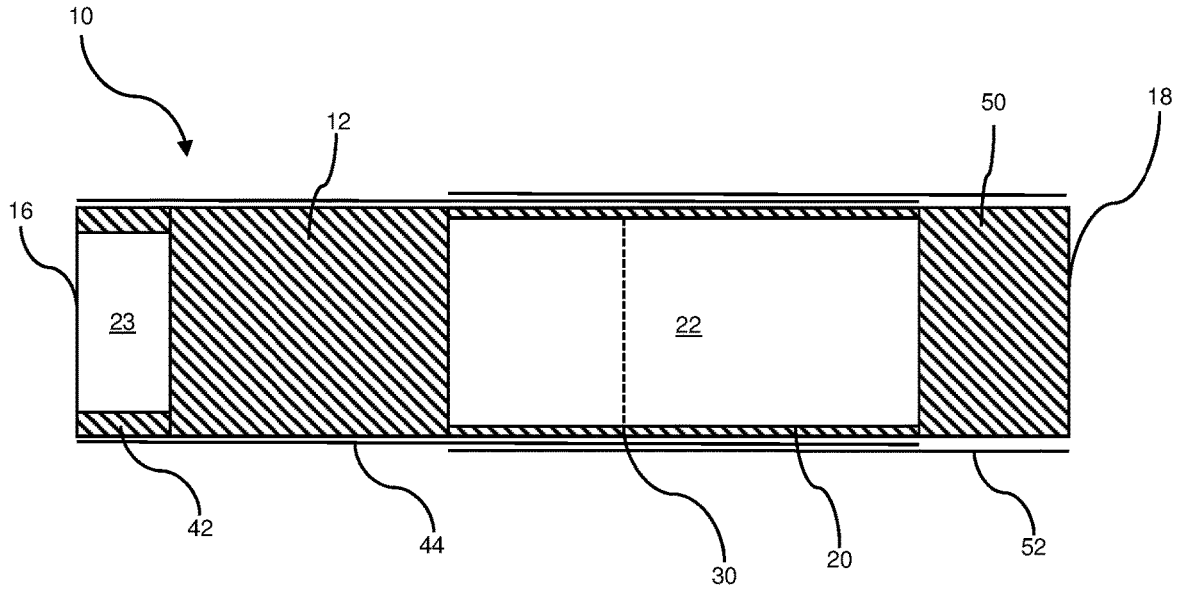
FIG. 2 shows a schematic side sectional view of the aerosol-generating article in accordance with an embodiment of the invention.

As shown in FIG. 2, the hollow tubular element 20 is provided in the form of a hollow cylindrical tube made of cardboard. The hollow tubular element 20 defines an internal cavity 22 that extends all the way from an upstream end of the hollow tubular element 20 to a downstream end of the hollow tubular element 20. The internal cavity 22 is substantially empty, and so substantially unrestricted airflow is enabled along the internal cavity 22. The hollow tubular element 20 does not substantially contribute to the overall RTD of the aerosol-generating article 10.

The hollow tubular element 20 has a length of about 21 millimetres, an external diameter of about 7.2 millimetres, and an internal diameter of about 6.7 millimetres. Thus, a thickness of a peripheral wall of the hollow tubular element 20 is about 0.25 millimetres.

The aerosol-generating article 10 comprises a ventilation zone 30 provided at a location along the hollow tubular element 20. In more detail, the ventilation zone 30 is provided at about 16 millimetres from the downstream end 18 of the article 10. The ventilation zone 30 is provided at about 12 mm downstream from the downstream end of the rod 12 of aerosol-generating substrate. The ventilation zone 30 is provided at about 9 mm upstream from the upstream end of the mouthpiece element 50. The ventilation zone 30 comprises a circumferential row of openings or perforations circumscribing the hollow tubular element 20. The perforations of the ventilation zone 30 extend through the wall of the hollow tubular element 20, in order to allow fluid ingress into the internal cavity 22 from the exterior of the article 10. A ventilation level of the aerosol-generating article 10 is about 16 percent.

On top of a rod 12 of aerosol-generating substrate and a downstream section 14 at a location downstream of the rod 12, the aerosol-generating article 100 comprises an upstream section 40 at a location upstream of the rod 12. As such, the aerosol-generating article 10 extends from a distal end 16 substantially coinciding with an upstream end of the upstream section 40 to a mouth end or downstream end 18 substantially coinciding with a downstream end of the downstream section 14.

The upstream section 40 comprises an upstream element 42 located immediately upstream of the rod 12 of aerosol-generating substrate, the upstream element 42 being in longitudinal alignment with the rod 12. The downstream end of the upstream element 42 abuts the upstream end of the rod 12 of aerosol-generating substrate. The upstream element 42 is provided in the form of a hollow cylindrical plug of cellulose acetate tow having a wall thickness of about 1 mm and defining an internal cavity 23. The upstream element 42 has a length of about 5 millimetres. An external diameter of the upstream element 42 is about 7.1 mm. An internal diameter of the upstream element 42 is about 5.1 mm.

The mouthpiece element 50 extends from the downstream end of the hollow tubular element 20 to the downstream or mouth end of the aerosol-generating article 10. The mouthpiece element 50 has a length of about 7 mm. An external diameter of the mouthpiece element 50 is about 7.2 mm. The mouthpiece element 50 comprises a low-density, cellulose acetate filter segment. The RTD of the mouthpiece element 50 is about 8 mm $H_2O$. The mouthpiece element 50 may be individually wrapped by a plug wrap (not shown).

As shown in FIGS. 1 & 2, the article 10 comprises an upstream wrapper 44 circumscribing the upstream element 42, the aerosol-generating substrate 12 and the hollow tubular element 20. The ventilation zone 30 may also comprise a circumferential row of perforations provided on the upstream wrapper 44. The perforations of the upstream wrapper 44 overlap the perforations provided on the hollow tubular element 20. Accordingly, the upstream wrapper 44 overlies the perforations of the ventilation zone 30 provided on the hollow tubular element 20.

The article 10 also comprises a tipping wrapper 52 circumscribing the hollow tubular element 20 and the mouthpiece element 50. The tipping wrapper 52 overlies the portion of the upstream wrapper 44 that overlies the hollow tubular element 20. This way the tipping wrapper 52 effectively joins the mouthpiece element 50 to the rest of the components of the article 10. The width of the tipper wrapper 52 is about 26 mm. Additionally, the ventilation zone 30 may comprise a circumferential row of perforations provided on the tipping wrapper 52. The perforations of the tipping wrapper 52 overlap the perforations provided on the hollow tubular element 20 and the upstream wrapper 44. Accordingly, the tipping wrapper 52 overlies the perforations of the ventilation zone 30 provided on the hollow tubular element 20 and the upstream wrapper 44.

Figure 3:
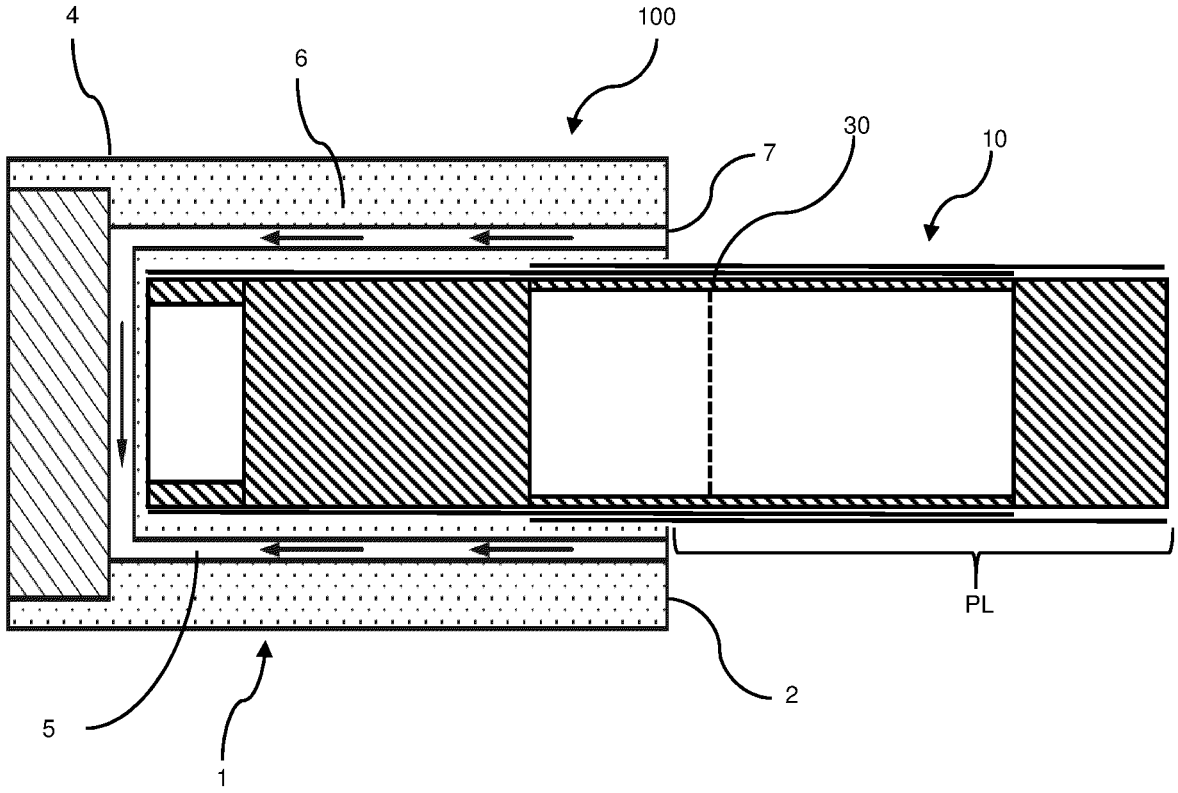
FIG. 3 shows a schematic side sectional view of the aerosol-generating system comprising an aerosol-generating article in accordance with an embodiment of the invention and an aerosol-generating device.

FIG. 3 illustrates an aerosol-generating system 100 comprising an exemplary aerosol-generating device 1 and the aerosol-generating article 10, equivalent to that shown in FIGS. 1 & 2. FIG. 3 illustrates a downstream, mouth end portion of the aerosol-generating device 1 where the device cavity is defined and the aerosol-generating article 10 can be received. The aerosol-generating device 1 comprises a housing (or body) 4, extending between a mouth end 2 and a distal end (not shown). The housing 4 comprises a peripheral wall 6. The peripheral wall 6 defines a device cavity for receiving an aerosol-generating article 10. The device cavity is defined by a closed, distal end and an open, mouth end. The mouth end of the device cavity is located at the mouth end of the aerosol-generating device 1. The aerosol-generating article 10 is configured to be received through the mouth end of the device cavity and is configured to abut a closed end of the device cavity.

A device air flow channel 5 is defined within the peripheral wall 6. The air-flow channel 5 extends between an inlet 7 located at the mouth end of the aerosol-generating device 1 and the closed end of the device cavity. Air may enter the aerosol-generating substrate 12 via an aperture (not shown) provided at the closed end of the device cavity, ensuring fluid communication between the air flow channel 5 and the aerosol-generating substrate 12.

The aerosol-generating device 1 further comprises a heater (not shown) and a power source (not shown) for supplying power to the heater. A controller (not shown) is also provided to control such supply of power to the heater. The heater is configured to controllably heat the aerosol-generating article 10 during use, when the aerosol-generating article 1 is received within the device 1. The heater is preferably arranged to externally heat the aerosol-generating substrate 12 for optimal aerosol generation. The ventilation zone 30 is arranged to be exposed when the aerosol-generating article 10 is received within the aerosol-generating device 1.

In the embodiment shown in FIG. 3, the device cavity defined by the peripheral wall 6 is 28 mm in length. When the article 10 is received within the device cavity, the upstream section 40, the rod of aerosol-generating substrate 12 and an upstream portion of the hollow tubular element 20 are received within the device cavity. Such an upstream portion of the hollow tubular element 20 is 11 mm in length. Accordingly, about 28 mm of the article 10 is received within the device 1 and about 17 mm of the article 10 is located outside of the device 1. In other words, about 17 mm of the article 10 protrudes from the device 1 when the article 10 is received therein. Such a length PL of the article 10 protruding from the device 1 is shown in FIG. 3.

As a result, the ventilation zone 30 is advantageously located outside of the device 1 when the article 10 is inserted in the device 1. Where the device cavity is 28 mm long, the ventilation zone 30 is located 1 mm downstream from the mouth end 2 of the device 1 when the article 10 is received within the device 1. For the purpose of the present description and of the appended claims, except where otherwise indicated, all numbers expressing amounts, quantities, percentages, and so forth, are to be understood as being modified in all instances by the term "about". Also, all ranges include the maximum and minimum points disclosed and include any intermediate ranges therein, which may or may not be specifically enumerated herein. In this context, therefore, a number A is understood as A±10% of A. Within this context, a number A may be considered to include numerical values that are within general standard error for the measurement of the property that the number A modifies. The number A, in some instances as used in the appended claims, may deviate by the percentages enumerated above provided that the amount by which A deviates does not materially affect the basic and novel characteristic(s) of the claimed invention. Also, all ranges include the maximum and minimum points disclosed and include any intermediate ranges therein, which may or may not be specifically enumerated herein.

The invention claimed is:

1. An aerosol-generating article, comprising:

a rod of aerosol-generating substrate having a length of between 8 mm and 16 mm;

an upstream element provided upstream of the rod of aerosol-generating substrate, the upstream element having an external diameter of between 6 mm and 8 mm, the upstream element comprising cellulose acetate;

a hollow tubular element provided downstream of the rod of aerosol-generating substrate, wherein the hollow tubular element abuts a downstream end of the aerosol-generating substrate, wherein an internal volume defined by the hollow tubular element is at least 300 cubic millimetres; and a ventilation zone configured to provide ventilation into the aerosol-generating article, the ventilation zone being located between 12 mm and 20 mm upstream from a downstream end of the aerosol-generating article.

2. The aerosol-generating article according to claim 1, wherein the ventilation zone is provided at a location along the hollow tubular element.

3. The aerosol-generating article according to claim 1, wherein the ventilation zone is located between 14 mm and 18 mm upstream from the downstream end of the aerosol-generating article.

4. The aerosol-generating article according to claim 1, wherein the ventilation zone is located at least 10 mm downstream from the downstream end of the rod of aerosol-generating substrate.

5. The aerosol-generating article according to claim 1, wherein the upstream element has a length of between 2 mm and 8 mm.

6. The aerosol-generating article according to claim 1, wherein a wall thickness of the hollow tubular element is at least 100 micrometres.

7. The aerosol-generating article according to claim 1, wherein a wall thickness of the hollow tubular element is no greater than 2 mm.

8. The aerosol-generating article according to claim 1, wherein the hollow tubular element consists of a continuous hollow tubular segment.

9. The aerosol-generating article according to claim 1, wherein a length of the hollow tubular element is at least 15 mm.

10. The aerosol-generating article according to claim 1, wherein the aerosol-generating substrate comprises one or more aerosol formers, and wherein a content of aerosol former in the aerosol-generating substrate is at least 10 percent by weight, on a dry weight basis.

11. The aerosol-generating article according to claim 1, wherein the aerosol-generating substrate comprises a shredded tobacco material.

12. The aerosol-generating article according to claim 11, wherein the shredded tobacco material has a density from 150 milligrams per cubic centimetre to 500 milligrams per cubic centimetre.

13. The aerosol-generating article according to claim 1, further comprising a mouthpiece element located downstream of the hollow tubular element.

14. An aerosol-generating system, comprising:

an aerosol-generating article according to claim 1; and an aerosol-generating device comprising a heating chamber configured to receive the aerosol-generating article and at least a heating element provided at or about a periphery of the heating chamber.

15. The aerosol-generating system according to claim 14, wherein, when the aerosol-generating article is received within the aerosol-generating device, a distance between the ventilation zone and the upstream end of the upstream element is greater than a length of the heating chamber.

* * * * *